US008186801B2

(12) United States Patent
Saita

(10) Patent No.: US 8,186,801 B2
(45) Date of Patent: May 29, 2012

(54) IMAGE FORMING DEVICE

(75) Inventor: Hirofumi Saita, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 487 days.

(21) Appl. No.: 12/412,111

(22) Filed: Mar. 26, 2009

(65) Prior Publication Data

US 2009/0244165 A1 Oct. 1, 2009

(30) Foreign Application Priority Data

Mar. 28, 2008 (JP) ..... 2008-088052

(51) Int. Cl.
*B41J 29/393* (2006.01)
*B41J 2/15* (2006.01)
*B41J 2/145* (2006.01)

(52) U.S. Cl. ..... 347/19; 347/5; 347/40; 347/41; 347/54

(58) Field of Classification Search ..... 347/19, 347/41

See application file for complete search history.

(56) References Cited

U.S. PATENT DOCUMENTS

| | | | | |
|---|---|---|---|---|
| 2003/0081037 | A1 | 5/2003 | Gaston et al. | |
| 2005/0046658 | A1* | 3/2005 | Kojima | 347/19 |
| 2006/0262151 | A1* | 11/2006 | Chiwata | 347/14 |
| 2007/0064077 | A1* | 3/2007 | Konno | 347/102 |

FOREIGN PATENT DOCUMENTS

| | | | |
|---|---|---|---|
| JP | 7-137290 | A | 5/1995 |
| JP | 9-141894 | A | 6/1997 |
| JP | 2002-160416 | A | 6/2002 |
| JP | 2003-159793 | A | 6/2003 |
| JP | 2004-209915 | A | 7/2004 |
| JP | 2004-338402 | A | 12/2004 |
| JP | 2005-231245 | A | 9/2005 |
| JP | 2006-347164 | A | 12/2006 |
| JP | 2007-160752 | A | 6/2007 |

OTHER PUBLICATIONS

JP Office Action issued in corresponding JP Application No. 2008-08052, dated Jan. 31, 2012.

* cited by examiner

*Primary Examiner* — Ryan Lepisto
(74) *Attorney, Agent, or Firm* — Birch, Stewart, Kolasch & Birch, LLP

(57) ABSTRACT

An image formation device that inspects for image irregularities caused by joining of inkjet head modules. The image formation device is equipped with a belt conveyance unit, a recording head, a print sensor and a system controller. The belt conveyance unit moves paper in a conveyance direction. At the recording head, modules including plural recording elements that eject ink droplets are joined up to a length corresponding to the width of the paper. The recording head ejects ink droplets at the paper being conveyed to form an image. The print sensor reads the image recorded on the paper, while moving in the width direction of the paper. On the basis of the image that is read, the system controller inspects the quality of the image recorded on the paper.

12 Claims, 21 Drawing Sheets

IMAGE FORMING DEVICE

CROSS-REFERENCE TO RELATED APPLICATIONS

This application is based on and claims priority under 35 USC 119 from Japanese Patent Application No. 2008-088052 filed Mar. 28, 2008, the disclosure of which is incorporated by reference herein.

BACKGROUND OF THE INVENTION

1. Field of the Invention

The present invention relates to an image forming device.

2. Description of the Related Art

Heretofore, there have been inline inspection devices for offset printing in which, in order to preserve image quality, plural line cameras are provided and images captured therewith are compared with desired original image data. Systems similar to such inline inspection devices are also known in inkjet recording devices.

Inline sensors, large numbers of which are used in offset printing in this manner, may perform sensing with high resolution. However, if a number of sensing pixels is to be increased, it is necessary to increase the number of inline sensors.

In Japanese Patent Application Laid-Open (JP-A) No. 2003-159793, a technology is disclosed that performs calibration of a print head of printing equipment in a short duration. As shown in FIG. 2 of JP-A No. 2003-159793, in this technology, test patterns 92, 94 and 96 are printed on a printing medium 90 using pens 50, 52, 54 and 56, which are ink ejection elements, and these test patterns 92, 94 and 96 are read with an optical scanner 80. This reading is implemented by scanning an effective width of the test patterns 92, 94 and 96 with a single pass of the optical scanner.

In JP-A No. 7-137290, a technology is disclosed that performs recording with different spreading characteristics of inks on recording mediums. In this technology, as shown in FIG. 1 of JP-A No. 7-137290, a test pattern is recorded outside a data recording region 21, an image of the test pattern is sensed, and recording conditions are adjusted in accordance with sensing results.

In JP-A No. 9-141894, a technology is disclosed that reliably detects clogging of nozzles without needing high sensing precision at a sensor, even in a case in which the nozzles have small diameters. In this technology, as shown in FIG. 1 of JP-A No. 9-141894, a nozzle group is divided into plural block units. Ink is blown onto paper 6 by the block units and marks 52 are sequentially formed. Densities of the marks 52 are read by a clogging detection sensor 18. Irregularities at an inkjet head 31 are reported on the basis of whether or not marks 52 of which the read density values are at or below a predetermined value continue for at least a predetermined count.

In recent years, image quality requirements have risen, and qualities of inkjet heads that form images have risen correspondingly. Within individual inkjet modules that constitute an inkjet head (hereinafter referred to simply as modules), impact droplet sizes, direction variations, ejection speeds and timings are substantially uniform. Accordingly, image irregularities within a module are hardly ever seen.

However, inkjet heads are fabricated by repeated lithography of individual modules on wafers. Therefore, sizes thereof are limited by the process. In order to fabricate an inkjet head capable of image formation over the width of a page in one cycle, it is necessary to join and integrate modules fabricated by processing on wafers, and form the modules into an inkjet head bar for image formation.

In the current circumstances, image irregularities within modules are not a problem. However, positional offsets when modules are joined and differences in impact droplet sizes, impact droplet speeds and timings between modules, which cause image irregularities, still occur. As things stand, conventional sensors are not capable of sensing positional offsets at joins of modules.

SUMMARY OF THE INVENTION

The present invention provides an image forming device capable of inspecting for image irregularities caused by joining of inkjet head modules.

A first aspect of the present invention is an image forming device including: a conveyance unit that moves a recording medium in a conveyance direction; a recording head including modules connected such that a total length thereof corresponds to a width of the recording medium, the modules including plural recording elements that eject ink droplets, and the recording head ejecting ink droplets at the recording medium being conveyed by the conveyance unit thereby forming an image; a reading unit that reads the image recorded at the recording medium by the recording head while moving in a width direction of the recording medium; and an inspection unit that inspects the quality of the image recorded at the recording medium on the basis of the image read by the reading unit.

BRIEF DESCRIPTION OF THE DRAWINGS

An exemplary embodiment of the present invention will be described in detail based on the following figures, wherein.

DETAILED DESCRIPTION OF THE INVENTION

Figure 1:
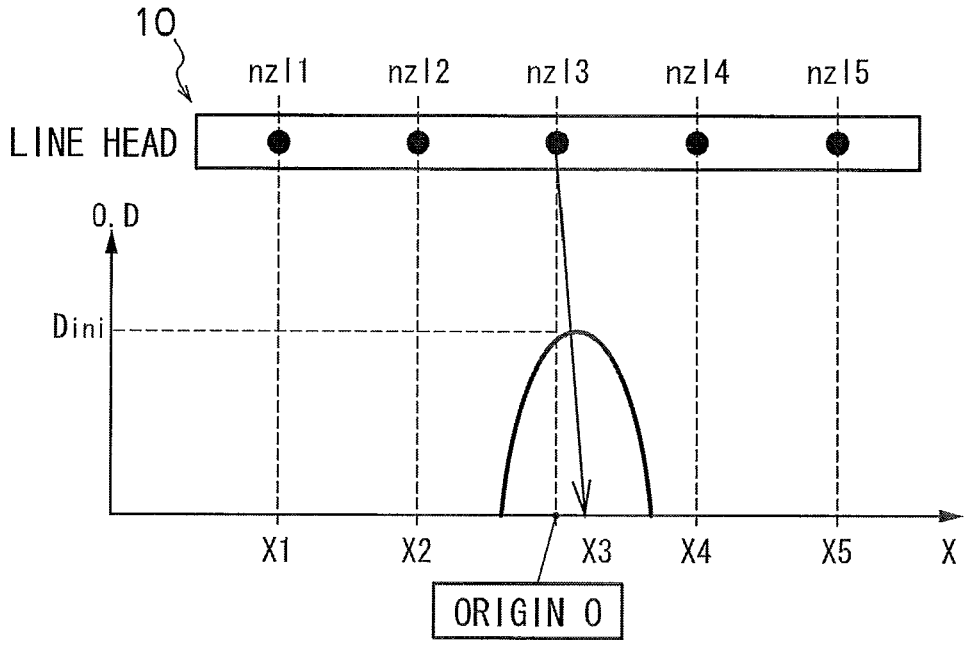
FIG. 1 is an explanatory diagram showing an example of a density profile before correction of density irregularities by an exemplary embodiment of the present invention.

Herebelow, an exemplary embodiment of the present invention will be described in detail while referring to the drawings.

—Principle of Correction—

First, a principle of correction will be described. In processing for correction of density irregularities according to the exemplary embodiment of the present invention described herein, when an error in the impact position of a certain nozzle is to be corrected, the correction is implemented using N surrounding nozzles, including that nozzle. As will be described in more detail hereafter, the larger the number N of nozzles used in correction, the greater the precision of correction.

FIG. 1 is a diagram showing a state before correction. In FIG. 1, the third nozzle from the left (nzl3) of a line head 10 (which corresponds to a recording head) has an impact position error. As a result, the nozzle impacts with an impact position shifted to the right in the drawing (along a main scanning direction indicated by the X axis) from an ideal impact position (the origin point O). The graph shown at the lower side of FIG. 1 represents a density profile in the direction of the nozzle row (the main scanning direction), which is obtained by averaging print densities due to droplets from a nozzle over a recording medium conveyance direction (sub-scanning direction). In FIG. 1, correction of printing by the nozzle nzl3 is being considered, so density outputs other than nozzle nzl3 are not shown in the drawing.

Initial output densities of the nozzles nzl1 to nzl5 are Di, which equal $D_{ini}$ (where i represents a nozzle number of 1 to 5 and $D_{ini}$ represents a set value), the ideal impact position of nozzle nzl3 is the origin point O, and impact positions of the nozzles nzl1 to nzl5 are Xi.

Physically, Di represents an output optical density of a nozzle averaged over the recording medium conveyance direction. That is, Di represents a value averaged over j of density data D(i,j) of pixels in data processing (where i represents nozzle numbers and j represents pixel numbers in the recording medium conveyance direction).

As shown in FIG. 1, the impact position error of nozzle nzl3 is represented as a shift from the origin point O of the density output of the nozzle nzl3 (the thick line). Now, correcting this shift of the output density will be considered.

Figure 2:
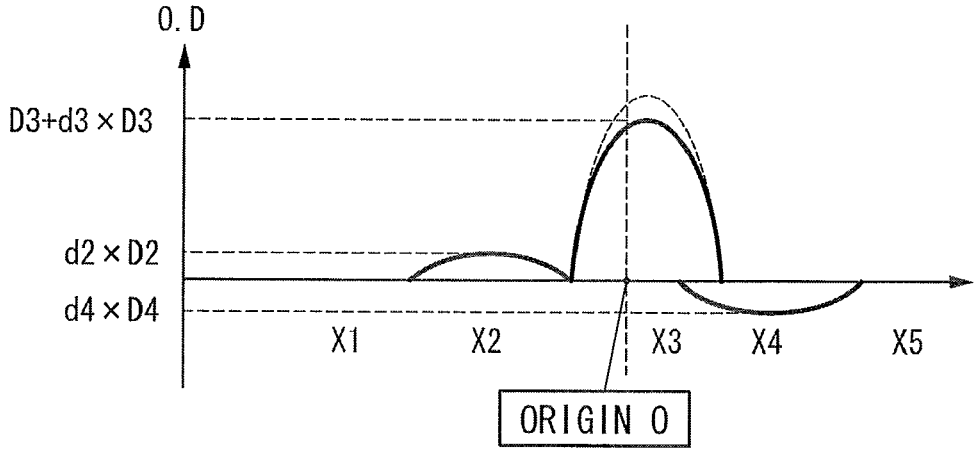
FIG. 2 is an explanatory diagram showing a state after correction of density irregularities by the exemplary embodiment of the present invention.

FIG. 2 is a diagram showing a state after correction. Apart from nozzle nzl3, only correction amounts are shown. In the case of FIG. 2, the number of nozzles used for correction is N=3. Density correction coefficients d2, d3 and d4 are applied to the nozzles nzl2, nzl3 and nzl4. The density correction coefficients di referred to here are coefficients defined such that, where an output density after correction is to be Di', Di'=Di+di×Di.

In the present exemplary embodiment, the density correction coefficients di of nozzles are defined such that visibilities of density irregularities are minimized. Density irregularities of a print image are represented by intensities in a spatial frequency characteristic (a power spectrum). Because high-frequency components are not visible to human eyes, visibilities of density irregularities are equivalent to low-frequency components of a power spectrum. Therefore, the density correction coefficients di of the nozzles are determined so as to minimize low-frequency components of a power spectrum.

Details of the derivation of equations for determining the density correction coefficients di are described below. Showing just the result first, the density correction coefficient di for the impact position error of a specific nozzle is determined by the following equation.

$$d_i = \begin{cases} \dfrac{\prod_k x_k}{x_i \cdot \prod_{k \neq i} (x_k - x_i)} - 1 & \text{(nozzles to be corrected)} \\ \dfrac{\prod_k x_k}{x_i \cdot \prod_{k \neq i} (x_k - x_i)} & \text{(other nozzles)} \end{cases} \tag{1}$$

Here, xi are the respective impact positions of the nozzles, with the ideal impact position of the nozzle to be corrected as the origin point. "Π" means finding a product over the N nozzles that are used for correction. In FIG. 2, a case with N=3 is specifically represented, and is as follows.

$$d_2 = \frac{x_2 \cdot x_3 \cdot x_4}{x_2 \cdot (x_3 - x_2) \cdot (x_4 - x_2)}$$

$$d_3 = \frac{x_2 \cdot x_3 \cdot x_4}{x_3 \cdot (x_2 - x_3) \cdot (x_4 - x_3)} - 1$$

$$d_4 = \frac{x_2 \cdot x_3 \cdot x_4}{x_4 \cdot (x_2 - x_4) \cdot (x_3 - x_4)}$$

—Derivation of Density Correction Coefficients—

The density correction coefficients of the nozzles may in principle be derived from the condition that low frequency components of the power spectrum of a density irregularity should be minimized.

Firstly, a density profile incorporating error characteristics of the nozzles is defined as in the following equation.

$$D(x) = \sum_i D_i \cdot z(x - x_i)$$

| | |
|---|---|
| i | Nozzle number |
| x | Co-ordinate of position on medium (in nozzle row direction) |
| Di | Nozzle output density (height of peak) |
| z(x) | Standard density profile (x = 0 for center of gravity position) |
| $x_i = \bar{x}_i + \Delta x_i$ | Impact position of nozzle i (ideal position + error) |

The density profile D(x) of an image is the sum of density profiles printed by the respective nozzles. A representation of printing by a nozzle is a print model (a density profile printed by one nozzle). The print model is expressed with a nozzle output density Di and a standard density profile z(x) being separated.

The standard density profile z(x), strictly speaking, has a limited width equivalent to a dot diameter. However, if correction of a positional error is considered as a problem of balancing a density shift, the important point is a position of the center of mass of the density profile (the impact position), while the width of the density profile is a secondary matter. Therefore, it is appropriate to approximate by replacing the profile with a δ function. If this kind of standard density profile is assumed, mathematical manipulations become simpler and exact solutions of the correction coefficients can be obtained.

Figure 3A:
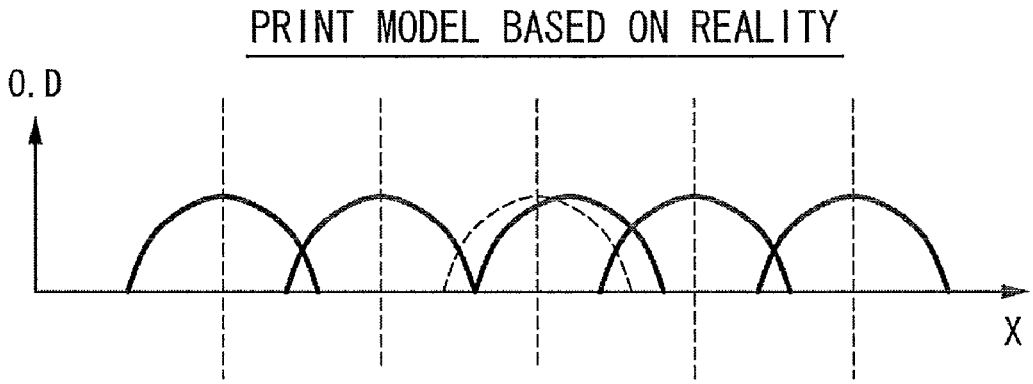
FIG. 3A is a view of a density profile of a print model based on reality.
Figure 3B:
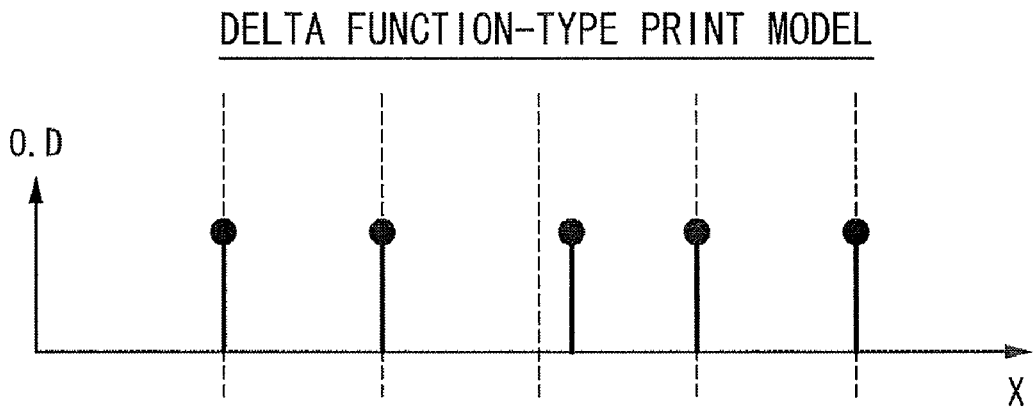
FIG. 3B is a view of a density profile of a δ function-type print model.

FIG. 3A is a print model based on reality, and FIG. 3B is a δ function-type print model. In a case of approximating with a δ function model, the standard density profile is represented by the following equation.

$$\delta \text{ function model: } z(x-x_i)=\delta(x-x_i)$$

When deriving correction coefficients, correction of an impact position error $\Delta x\mathbf{0}$ of a particular nozzle (i=0) by N surrounding nozzles is considered. Here, the number of the nozzles to be corrected is i=0. Note that the surrounding nozzles may also have a predetermined impact position error.

The numbers (indexes) of the N nozzles including the correction object nozzle (the central nozzle) are represented by the following equation.

$$\text{nozzle index: } i = -\frac{N-1}{2}, \ldots -1, 0, 1, \ldots \frac{N-1}{2}$$

(N nozzles in total, including the central nozzle)

In this equation, it is required that N is an odd number. However, N is not necessarily limited to odd numbers in embodiments of the present invention.

An initial output density (an output density before correction) is assumed to have a value only for i=0, and is represented by the following equation.

$$D_i = \begin{cases} D_{ini} & (i=0) \\ 0 & (i \neq 0) \end{cases}$$

When a density correction coefficient is di, a corrected output density Di' is represented by the following equation.

$$D'_i = D_i + d_i \times D_{ini} = d'_i \times D_{ini}$$

In which:

$$d'_i = \begin{cases} d_i + 1 & (i=0) \\ d_i & (i \neq 0) \end{cases}$$

That is, Di' at i=0 is represented by the sum of the initial output density value and the correction value ($di \times D_{ini}$), but is only the correction value at $i \neq 0$.

The impact position xi of each nozzle i is represented by the following equation.

$$\text{Impact position: } x_i = \overline{x_i} + \Delta x_i$$

In which: $\overline{x_i}$ is an ideal impact position, and $\Delta x_i$ is the impact position error The ideal impact position of the nozzle to be corrected is the origin point ($\overline{x_0}=0$)

When the δ function-type print model is used, the density profile after correction is represented by the following equation.

$$D(x) = \sum_{i=-(N-2)/2}^{i=(N-2)/2} D'_i \cdot \delta(x - x_i) = D_{ini} \cdot \sum_{i=-(N-1)/2}^{i=(N-1)/2} d'_i \cdot \delta(x - x_i)$$

If a Fourier transform is applied thereto, this is represented by the following equation.

$$\begin{aligned} T(f) &= \int_{-\infty}^{\infty} D(x) \cdot e^{ifx} dx \\ &= \sum_i d'_i \cdot \int_{-\infty}^{\infty} \delta(x - x_i) \cdot e^{ifx} dx \\ &= \sum_i d'_i \cdot e^{ifx_i} \end{aligned}$$

$D_{ini}$ is a common constant so is omitted here.

Minimizing the visibility of density irregularities means minimizing low-frequency components of the power spectrum of the following equation.

$$\text{Power spectrum} = \int T(f)^2 df$$

Mathematically, this may be approximated by differential coefficients (first order, second order, etc.) of T(f) being zero at f=0. Here, because there are N unknown values di', if a condition of coefficients up to the N−1th order being zero and a DC component conservation condition are utilized, the entire (N) unknowns di' can be exactly determined. Accordingly, the following correction conditions are set.

DC component T(f=0)=1 (DC conservation condition)

First order coefficient:

$$\frac{d}{df} T(f=0) = 0$$

Second order coefficient:

$$\frac{d^2}{df^2} T(f=0) = 0$$

. . .

N−1th order coefficient:

$$\frac{d^{N-1}}{df^{N-1}} T(f=0) = 0$$

With the δ function model, when the correction conditions are expanded, Di resolves to N simultaneous equations by simple calculation. When the expanded correction conditions are rearranged, the following set of conditions (set of equations) is obtained.

$$\Sigma d'_i = 1$$

$$\Sigma x_i d'_i = 0$$

$$\Sigma x_i^2 d'_i = 0$$

. . .

$$\Sigma x_i^{N-1} d'_i = 0$$

The significance of this set of equations is that the first is conservation of a DC component and the second represents conservation of the position of center of mass. The third and others statistically represent an N−1th order moment being zero.

If the condition equations obtained in this manner are represented in a matrix format, they may be represented as follows.

$$\begin{pmatrix} 1 & \cdots & 1 & \cdots & \cdots & 1 \\ x_{-(N-1)/2} & \cdots & x_0 & \cdots & \cdots & x_{(N-1)/2} \\ x^2_{-(N-1)/2} & \cdots & x_0^2 & \cdots & \cdots & x^2_{(N-1)/2} \\ \vdots & & & \ddots & & \\ \vdots & & & & \ddots & \\ x^{N-1}_{-(N-1)/2} & \cdots & x_0^{N-1} & \cdots & \cdots & x^{N-1}_{(N-1)/2} \end{pmatrix} \begin{pmatrix} d'_{-(N-1)/2} \\ \vdots \\ \vdots \\ d'_0 \\ \vdots \\ d'_{(N-1)/2} \end{pmatrix} = \begin{pmatrix} 1 \\ 0 \\ \vdots \\ 0 \\ \vdots \\ 0 \end{pmatrix}$$

This coefficient matrix A is what is known as a Vandermonde matrix. Using the difference product, the determinant thereof gives the following equation.

$$|A| = \prod_{j>k} (x_j - x_k)$$

Hence, exact solutions of di' may be found using Cramer's rule. Detailed procedures of calculation are not given but, by algebraic manipulations, the solutions are shown by the following equation.

$$d'_i = \frac{\prod_k x_k}{x_i \cdot \prod_{k \neq i} (x_k - x_i)}$$

Thus, the correction coefficients di that are to be found are as in the following equation.

$$d_i = \begin{cases} \dfrac{\prod_k x_k}{x_i \cdot \prod_{k \neq i} (x_k - x_i)} - 1 & (i = 0) \\ \dfrac{\prod_k x_k}{x_i \cdot \prod_{k \neq i} (x_k - x_i)} & (i \neq 0) \end{cases}$$

As described above, from the condition that the differential coefficient at zero of the power spectrum should be zero, exact solutions of the density correction coefficients di are derived. The greater the number of surrounding nozzles N used for correction, the higher the order of differential coefficients that can be made zero. Accordingly, low-frequency energies are smaller and visibilities of irregularities are further reduced.

In the present exemplary embodiment, the condition of the differential coefficient at zero being zero is used. However, rather than being absolutely zero, the low frequency components of the power spectrum of density irregularities may be made sufficiently small if a value that is much smaller than the differential coefficient before correction (for example, 1/10 of the value before correction) is specified. That is, in respect of a condition that low frequency components of the power spectrum should be reduced to an extent such that the density irregularities are not visible, the differential coefficient at zero of the power spectrum is set to a sufficiently small value (substantially zero). Given this, values in ranges of up to 1/10 or less of the absolute values of the differential coefficients before correction are acceptable.

—Results of Correction Using the Above-Described Density Correction Coefficients—

Figure 4:
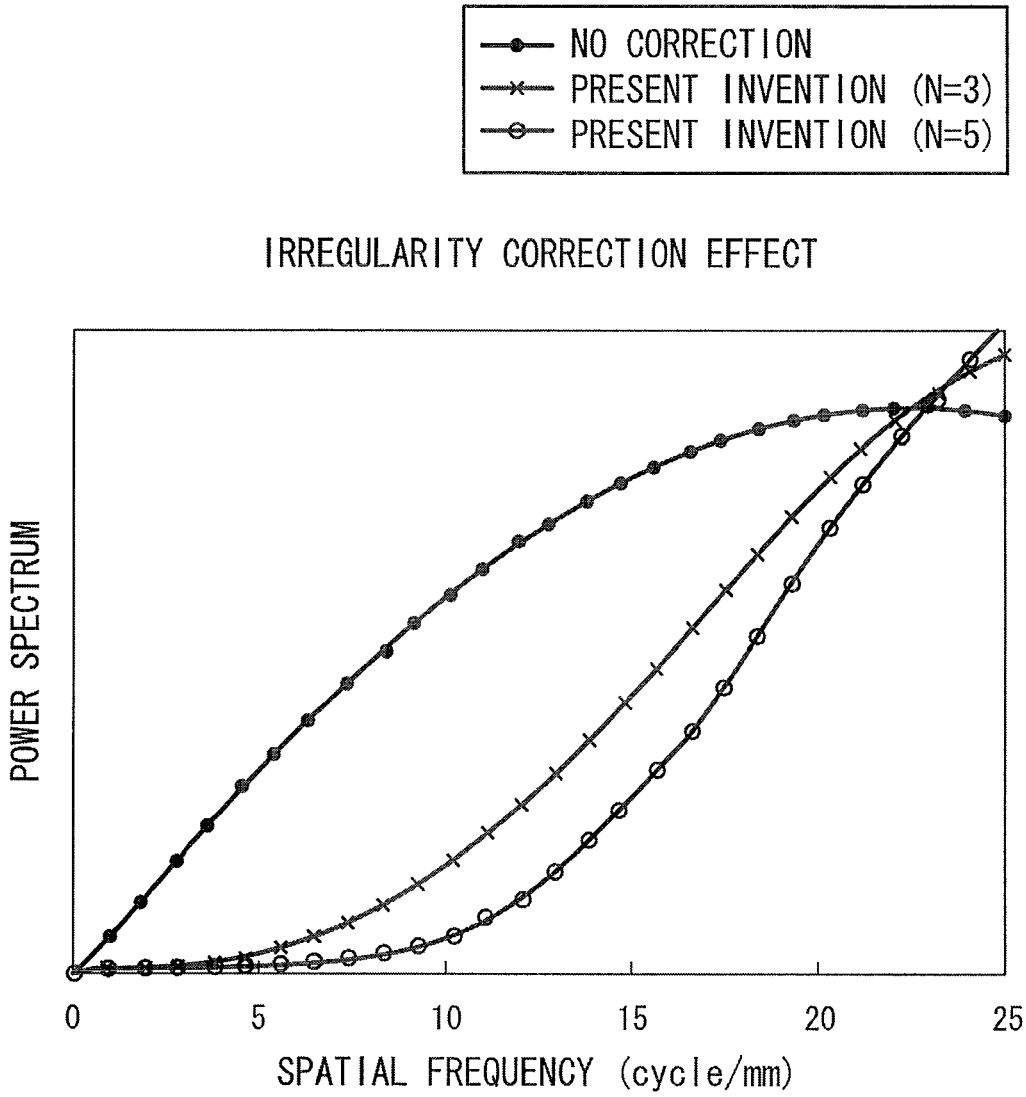
FIG. 4 is a graph of a power spectrum illustrating effects of correction by the present exemplary embodiment.

FIG. 4 illustrates spatial frequency characteristics (power spectra) after correction for the nozzles with the impact position error illustrated in FIG. 1. In FIG. 4, an example of correction when N=3 according to an example of the present invention and an example of correction when N=5 according to an example of the present invention are illustrated. Common conditions used in the calculations are that the dot density is 1200 dpi, the dot impact diameter is 32 μm and the nozzle position error (the impact position error) is 10 μm.

Considering the characteristics of human vision, the visibility of a density irregularity is represented by low frequency components from 0 to 8 cycle/mm. This means that the smaller the power spectrum in this region, the higher the correction accuracy.

In correction example 1 according to an example of the present invention (N=3), the power spectrum is substantially zero from 0 to 5 cycle/mm. This illustrates that there is a significant correction effect in comparison with a case of no correction. Correction example 2 according to an example of the present invention (N=5) reduces the power spectrum further than correction example 1 (N=3). Thus, it is verified that the correction effect improves as the number of nozzles used in correction N increases. In the case in FIG. 1, the output density of the correction object nozzle nzl3 does not physically extend into area 1 and area 5. However, the power spectrum may be further reduced when nozzles nzl1 and nzl5 too are used for correction.

Figure 5:
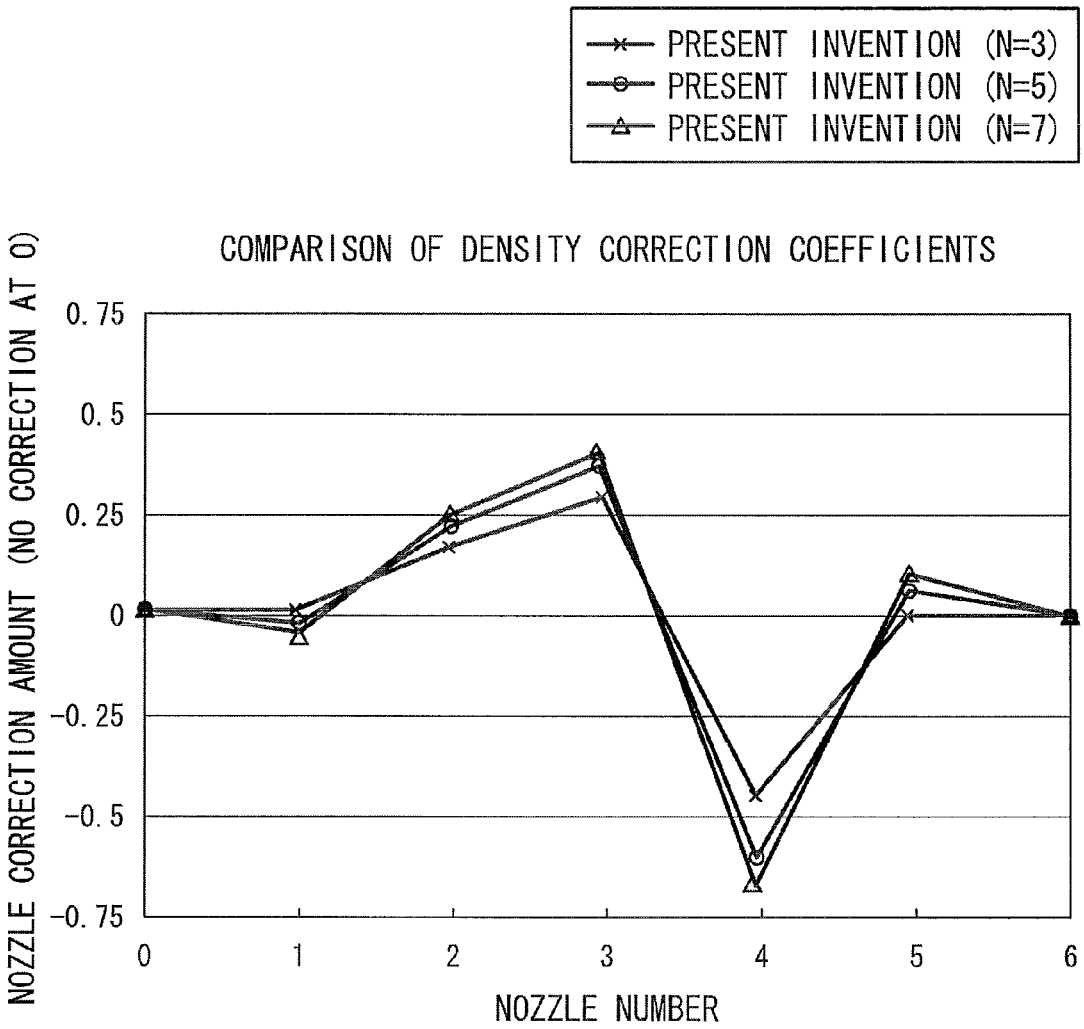
FIG. 5 is a graph used for describing a relationship between a number of nozzles used in correction (N) and density correction coefficients.

FIG. 5 is a comparison of density correction coefficients of correction examples 1 to 3 between which the number of nozzles used for correction is altered. As is seen by comparing correction example 1, according to the example of the present invention in which N=3, with correction example 2, according to the example of the present invention in which N=5, and correction example 3, according to an example of the present invention in which N=7, the correction accuracy is improved as the value of N increases. However, a magnitude of variation of the density correction coefficients becomes larger. Naturally, the larger an impact position error of a nozzle, the greater the magnitude of variation in the density correction coefficients will be.

If the number of density correction coefficients increases beyond a certain level, it is possible that reproduction of an input image will fail. Therefore, it is not preferable to increase the value of N more than necessary. Thus, an optimum value of N may be specified with regards to correction accuracy and image reproduction. The correction examples 1 to 3 with N=3 to N=7 illustrated in FIG. 5 are all cases in which the magnitude of variation (an absolute value) of the density correction coefficients is relatively small. Therefore, these will not cause reproduction of an input image to fail, and density irregularities may be corrected.

The above description describes a method of determining density correction coefficients for a particular single nozzle (for example, nozzle nzl3 in FIG. 1). In practice, all nozzles in a head will have some impact position error. Therefore, correction may be applied to all the impact position errors.

That is, the above-described density correction coefficients of N surrounding nozzles are found for all of the nozzles. Because above-described power spectrum minimization equations used when determining the density correction coefficients are linear, the power spectrum minimization equations may be superposed for the respective nozzles. Therefore, overall density correction coefficients can be found by taking sums of the density correction coefficients obtained in the manner described above.

That is, the density correction coefficient of nozzle i for a position error of nozzle k is d(i,k), and d(i,k) is found by the equation (1). Further, an overall density correction coefficient di for nozzle i is found by the following equation.

$$d_i = \sum_k d(i, k) \tag{2}$$

The above example sums over the indexes k, with the impact position errors of all the nozzles as values to be corrected. However, a constitution is possible in which some value ΔX_thresh is specified in advance as a threshold value and, only nozzles with impact position errors exceeding this threshold value are selected for correction.

As mentioned above, correction accuracy improves when the number N of nozzles used in correction is increased. However, the magnitude of variation of the density correction coefficients also increases, which may lead to failures in image reproduction. Therefore, in order to avoid image failures, a limiting range of the correction coefficients (an upper limit d_max and a lower limit d_min) may be specified. Hence, the values of N may be specified so as to keep the overall density correction coefficients found from the equation of equation (2) within the limit range. That is, the values of N are found so as to satisfy d_min<di<d_max.

According to experimental findings, image failures will not occur if d_min≧−1 and d_max≦1.

—Image Processing Flow—

Figure 6:
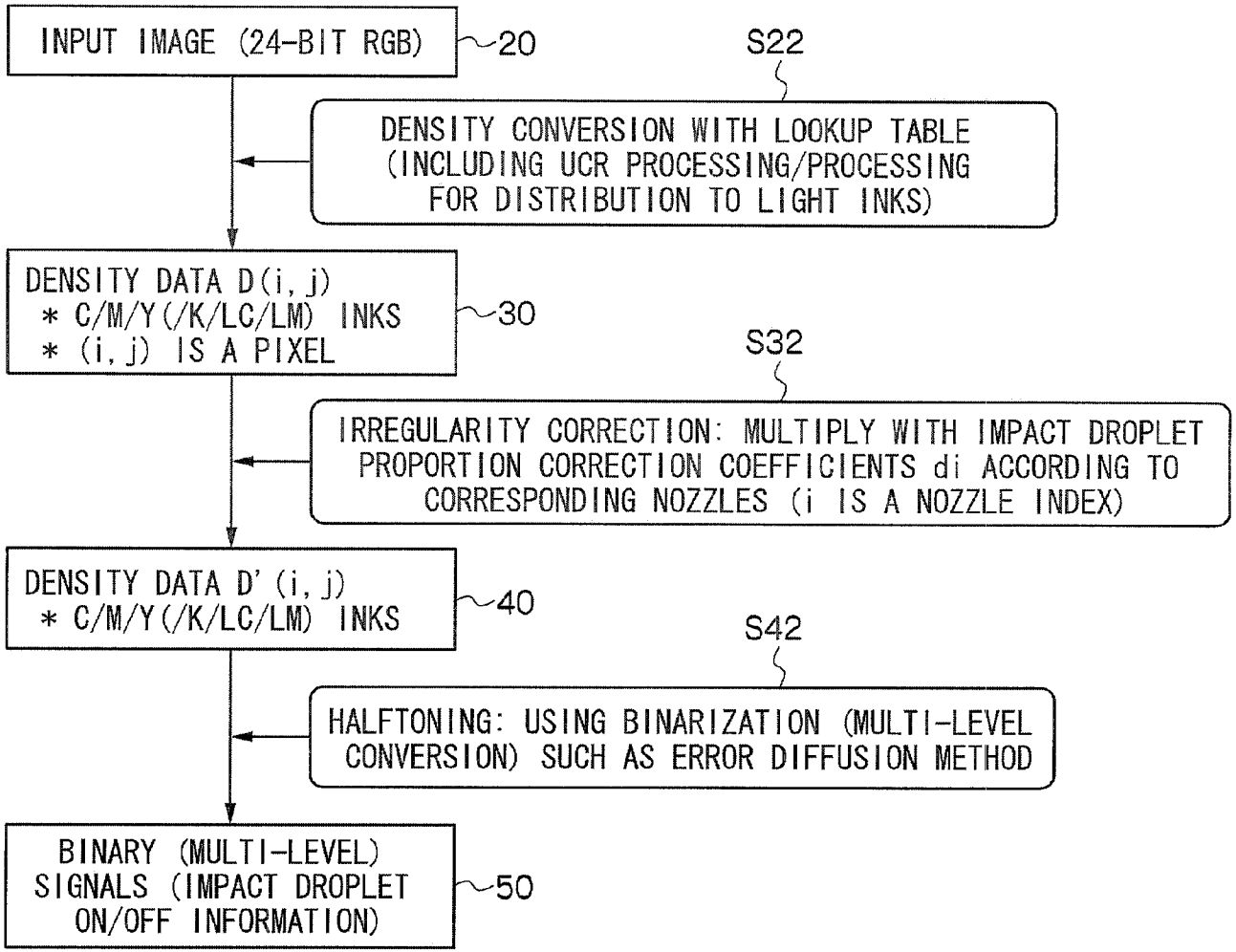
FIG. 6 is a flowchart showing a flow of image processing according to the present exemplary embodiment.

An image processing flow including an implementation of irregularity correction process according to the present exemplary embodiment is illustrated in FIG. 6.

The data format of an input image 20 is not particularly limited. For example, it may be 24-bit RGB data. Density conversion processing is carried out on the input image 20 with a lookup table (step S22). Thus, the input image 20 is converted to density data D(i,j) corresponding to the inks of a printer. Here, (i,j) represents the position of a pixel, and the density data is assigned for each pixel.

In this case it is assumed that the resolution of the input image 20 and the resolution (nozzle resolution) of the printer coincide. However, if the two do not coincide, a pixel count conversion of the input image is carried out to match the printer resolution.

The density conversion in step S22 is an ordinary process, including under color removal (UCR), distribution to light inks in the case of a system that uses light inks (paler inks of a matching color system), and the like.

For example, in the case the input image 20 is constituted by three inks, C (cyan), M (magenta) and Y (yellow), it is converted to CMY density data D(i,j). Alternatively, in the case of a system including other inks in addition to the three mentioned above, such as K (Black), LC (light cyan) and LM (light magenta) or the like, it is converted to density data D(i,j) including those ink colors.

Irregularity correction (step S32) is applied to the density data D(i,j) obtained by the density conversion (reference numeral 30 in FIG. 6). Here, calculations are carried out to multiply the density data D(i,j) by the density correction coefficients (impact droplet proportion correction coefficients) di according to the corresponding nozzles.

Figure 7:
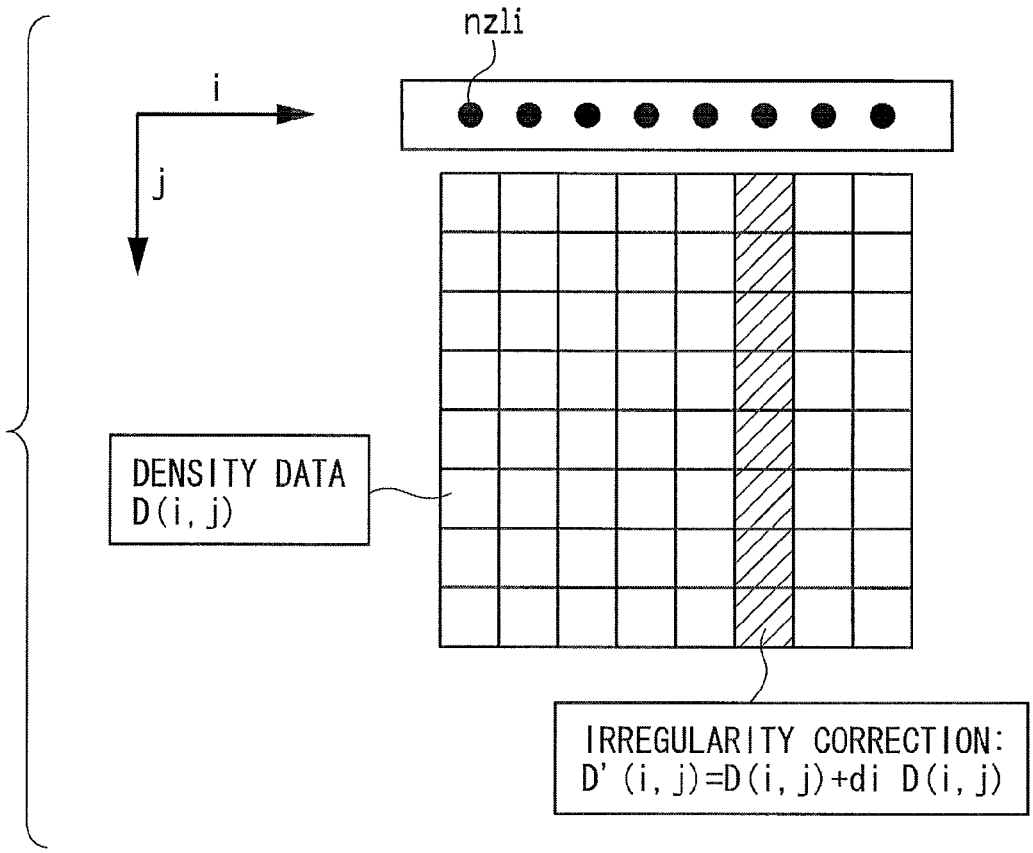
FIG. 7 is a conceptual diagram of density irregularity correction according to the present exemplary embodiment.

As shown in the schematic diagram of FIG. 7, a pixel position (i,j) in an image is defined by a position i (in a main scanning direction) of a nozzle nzli and a sub-scanning direction position j. Density data D(i,j) is provided for the respective pixels accordingly. When irregularity correction is to be performed for a nozzle that is responsible for the impact droplets of a pixel row, shown shaded in FIG. 7, corrected density data D'(i,j) is calculated with the following equation.

$$D'(i,j)=D(i,j)+di\times D(i,j)$$

Thus, the corrected density data D'(i,j) is obtained.

This corrected density data D'(i,j) (reference numeral 40 in FIG. 6) is converted to dot on/off signals (binary data) by halftoning (step S42), or multi-level data including size categories (dot size selections) in a case that includes dot size modulation. A method of halftoning is not particularly limited. A widely known binarization (or multi-level conversion) method may be used, such as the error diffusion method, the dithering method or the like.

Ink ejection (impact droplet) data for the nozzles is generated on the basis of the binary (or multi-level) signals that are obtained in this manner (reference numeral 50 in FIG. 6), and ejection operations are controlled. Thus, density irregularities are suppressed and high quality image formation is enabled.

Figure 8:
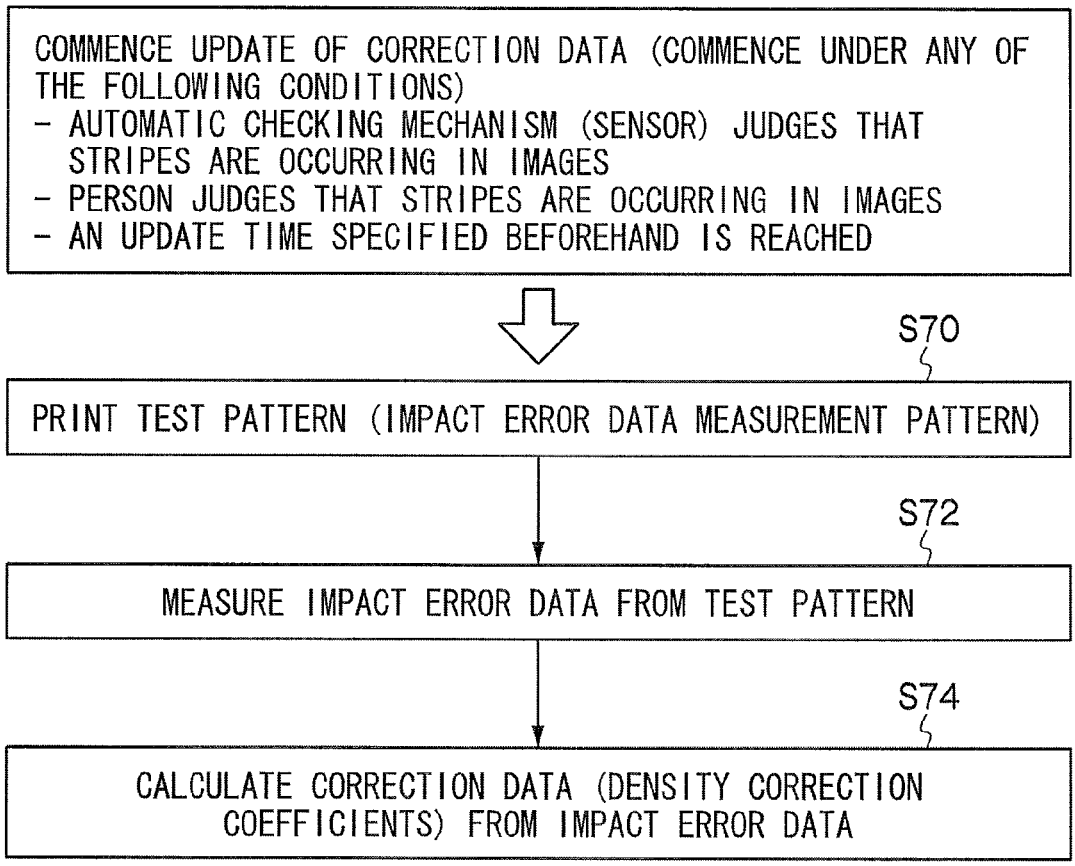
FIG. 8 is a flowchart showing a flow of correction data update.

FIG. 8 is a flowchart showing an example of processing for updating the density correction coefficients (correction data). This correction data update is commenced, for example, under any of the following conditions.

The illustrated update is started under any of the conditions: (a) it is judged by an automatic checking mechanism that monitors printing results (a sensor) that stripes are occurring in printed images; (b) a person (operator) looks at the printed images, judges that stripes are occurring in the images, and performs a predetermined operation (input of an instruction for starting the update processing or the like); and (c) an update time specified beforehand is reached (update times may be specified and judged by time management with a timer or the like, operation result management with a printout counter or suchlike, or the like).

When the update starts, firstly, a printout of a test pattern for measuring impact error data (a predetermined pattern specified in advance) is executed (step S70).

Then, impact error data is measured from print results of the test pattern (step S72). For the measurement of impact error data, an image reading device employing an image sensor (imaging device) (and including a signal processor that processes image signals) may be used. The impact error data includes information on impact position errors, optical density information and the like.

Then, correction data (density correction coefficients) is calculated (step S74) from the impact error data obtained in step S72. A method of calculation of the density correction coefficients is as described earlier.

Hence, information on the density correction coefficients that are found is stored in a rewritable storage such as an EEPROM or the like. Thereafter, the updated correction coefficients are used.

—Structure of Inkjet Recording Device—

Now, an inkjet recording device will be described, which serves as a concrete example of application of the image recording device equipped with a density irregularity correction function that is described above.

Figure 9:
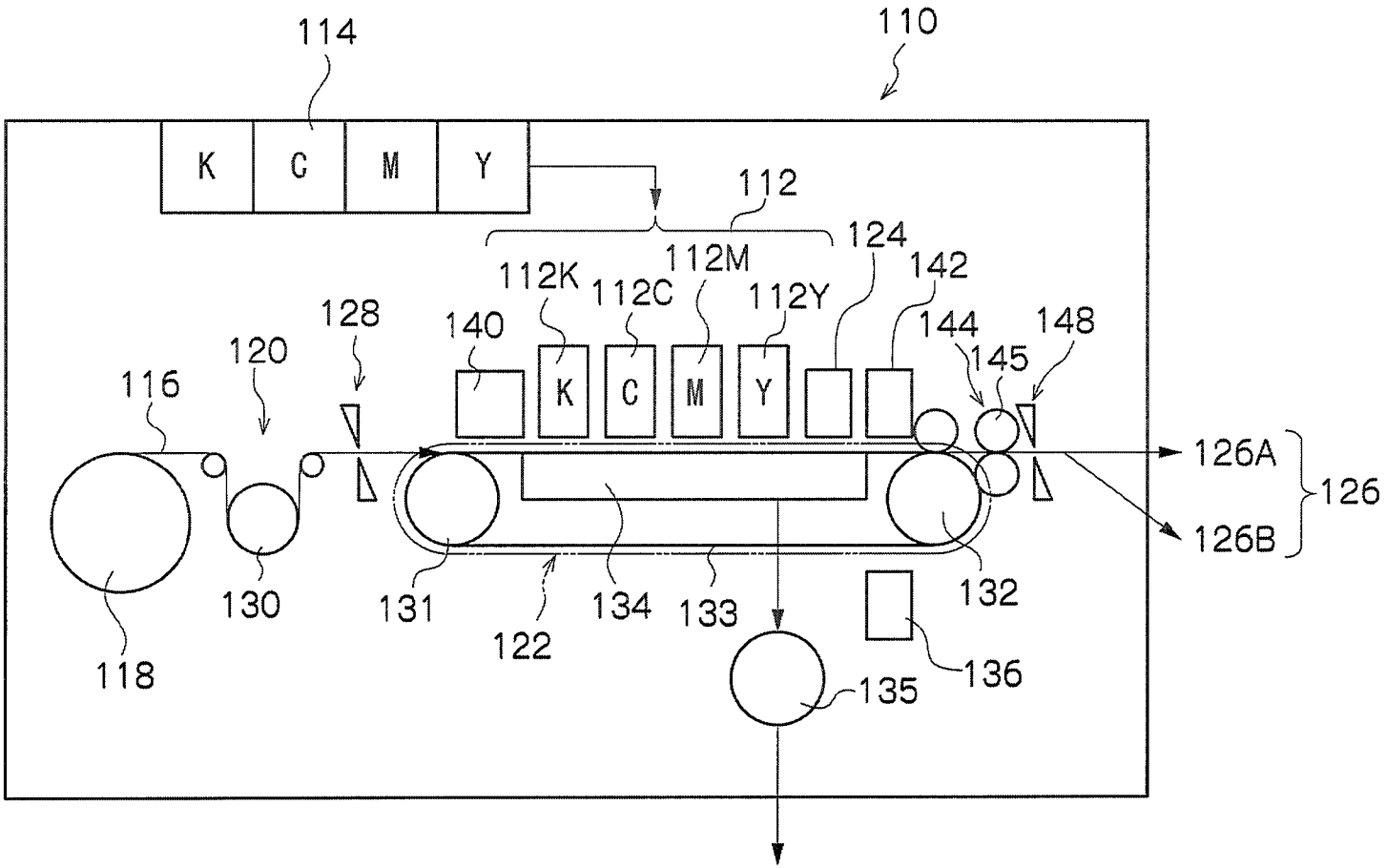
FIG. 9 is an overall structural view of an inkjet recording device illustrating an exemplary embodiment of the image recording device relating to the present invention.

FIG. 9 is an overall structural view of an inkjet recording device that represents a practical embodiment of the image recording device relating to the present invention. As shown in FIG. 9, this inkjet recording device 110 is equipped with a printing unit 112, an ink storage/charging unit 114, a paper supply unit 118, a de-curling unit 120, a belt conveyance unit 122, a print sensor 124 and a paper ejection unit 126. The printing unit 112 includes plural inkjet recording heads (below referred to as heads) 112K, 112C, 112M and 112Y, which are provided to correspond to inks of black (K), cyan (C), magenta (M) and yellow (Y). The ink storage/charging unit 114 stores inks to be supplied to the heads 112K, 112C, 112M and 112Y The paper supply unit 118 supplies recording paper 116, which is a recording medium. The de-curling unit 120 removes curl of the recording paper 116. The belt conveyance unit 122 is disposed to oppose nozzle faces (ink ejection faces) of the printing unit 112, and conveys the recording paper 116 while maintaining flatness of the recording paper 116. The print sensor 124 acquires results of printing by the printing unit 112. The paper ejection unit 126 ejects the printed recording paper (printed matter) to outside the inkjet recording device 110.

The ink storage/charging unit 114 includes ink tanks that store inks of colors corresponding to the heads 112K, 112C, 112M and 112Y The tanks are in fluid communication with the heads 112K, 112C, 112M and 112Y via required piping. The ink storage/charging unit 114 is equipped with a warning unit that gives a warning when a remaining amount of ink is small (a display unit or a warning sound unit) and a mechanism for preventing erroneous charging of the wrong color.

In the above, a case in which the conveyance unit is a belt conveyance unit is shown. However, a drum conveyance may also be employed as the conveyance unit. For example, this includes the case of SPPW type inkjet printer with a drum conveyance unit. In the explanation below, an example employing a drum conveyance unit is discussed.

In FIG. 9, a magazine of roll paper (continuous paper) is shown as an example of the paper supply unit 118. However, plural magazines with different paper widths, paper types and the like may be provided together. Furthermore, paper may be supplied by a cassette loaded with a stack of cut paper instead of or in addition to the magazine(s) of roll paper.

In a case a structure is formed that is capable of employing plural types of recording medium (media), an information recording body at which information about the type of medium is recorded, such as a barcode, a wireless tag or the like, may be attached to a magazine, and the information in this information recording body may be read by a predetermined reading device. Thus, a type of recording medium (media type) to be used may be automatically identified, and ink ejection control performed so as to realize suitable ink ejection in accordance with the media type.

The recording paper 116, which is fed from the paper supply unit 118, tends to retain winding due to having been charged in the magazine, and has curl. In order to remove this curl, the de-curling unit 120 provides heat to the recording paper 116 with a heating drum 130, around which the recording paper 116 is wound in the opposite direction to the direction of the winding tendency. Here, a heating temperature may be controlled such that there is slight curl with the print face to the outer side thereof.

If the apparatus is structured to employ roll paper, a shearing cutter (a first cutter) 128 is provided as shown in FIG. 9. The roll paper is cut to a desired size by the cutter 128. If cut paper is employed, the cutter 128 is not necessary.

After the de-curling, the cut recording paper 116 is fed to the belt conveyance unit 122. The belt conveyance unit 122 has a structure in which an endless belt 133 is wound on rollers 131 and 132. The belt conveyance unit 122 is structured so as to form a horizontal face (a flat face) opposing at least nozzle faces of the printing unit 112 and a sensor face of the print sensor 124.

The endless belt 133 has a width dimension greater than a width of the recording paper 116. Numerous suction holes (not shown) are formed in a belt face of the endless belt 133. As shown in FIG. 9, a suction chamber 134 is provided at the inner side of the endless belt 133 wound on the rollers 131 and 132, at positions opposing the nozzle faces of the printing unit 112 and the sensor face of the print sensor 124. Negative pressure is applied to the suction chamber 134 by suction with a fan 135, and the recording paper 116 is retained on the endless belt 133 by suction. An electrostatic adherence system may be employed instead of this suction adherence system.

Driving force of a motor is transmitted to one or both of the rollers 131 and 132 around which the endless belt 133 is wound. Accordingly, the endless belt 133 is driven in the clockwise direction of FIG. 9. Thus, the recording paper 116 retained on the endless belt 133 is conveyed from the left to the right of FIG. 9.

Ink will be applied to the endless belt 133 when an edgeless print or the like is printed. Therefore, a belt cleaning unit 136 is provided at a predetermined location of the outer side of the endless belt 133 (a suitable location outside a printing region). Structure of the belt cleaning unit 136 is not illustrated in detail. For example, there are systems of nipping with a brush roller, a water-absorbing roller or the like, air-blowing systems which blow on clean air, and combinations thereof. In the case of a system that nips with a cleaning roller, cleaning effects are greater if a linear speed of the roller is different to a linear speed of the belt.

Instead of the belt conveyance unit 122, a mode that uses a roller nipping conveyance mechanism can be considered. However, if a medium is conveyed through a printing region by roller nipping, a roller will touch against the printed face of paper immediately after printing, and there will be a problem in that images are likely to be smudged. Therefore, suction belt conveyance in which the image face is not touched at the printing region is preferable, as in the present example.

A heating fan 140 is provided on a paper conveyance path formed by the belt conveyance unit 122, at the upstream side relative to the printing unit 112. The heating fan 140 blows heated air at the recording paper 116 and warms the recording paper 116 before the printing. Because the recording paper 116 is warmed just before the printing, the ink dries more easily after impact.

Figure 10:
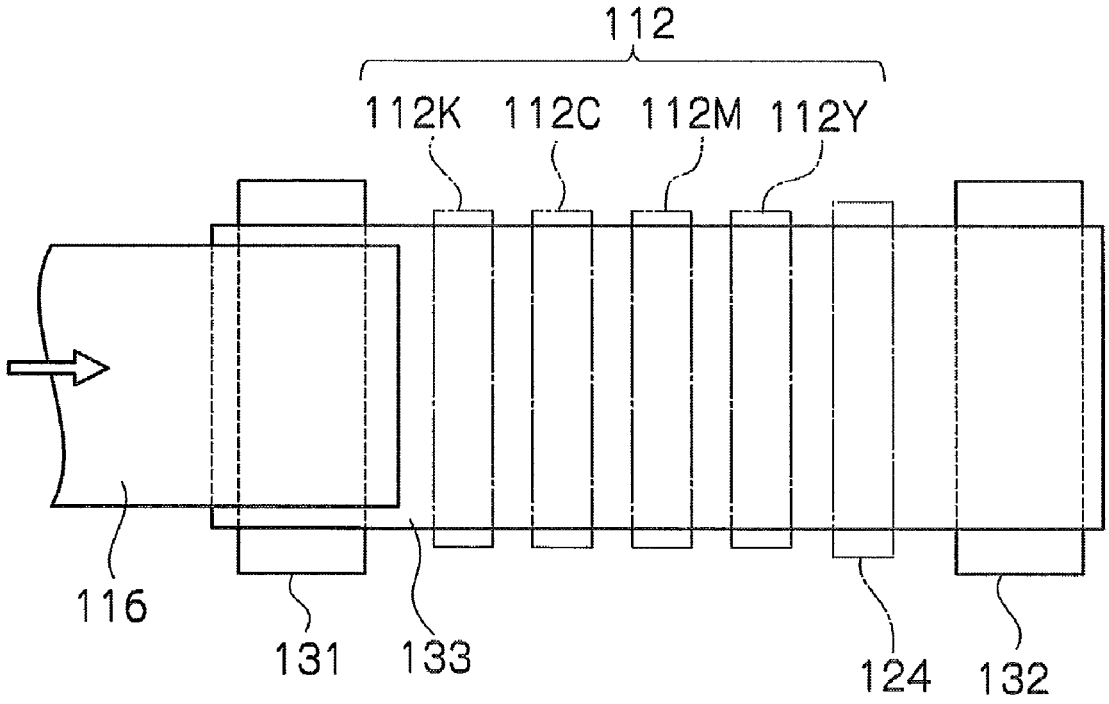
FIG. 10 is a plan view of principal elements surrounding a print area of the inkjet recording device shown in FIG. 9.

The heads 112K, 112C, 112M and 112Y of the printing unit 112 have sizes corresponding to a maximum paper width of the recording paper 116 to which the inkjet recording device 110 will be applied. The heads 112K, 112C, 112M and 112Y form full line-type heads in which the plural nozzles for ink ejection are arrayed in the nozzle faces over a length exceeding at least one side (the overall width of a printable range) of the maximum-size recording medium (see FIG. 10).

From the upstream side along the direction of conveyance of the recording paper 116, the heads 112K, 112C, 112M and 112Y are arranged in the order black (K), cyan (C), magenta (M) and yellow (Y). The heads 112K, 112C, 112M and 112Y are fixedly disposed so as to extend in a direction substantially orthogonal to the direction of conveyance of the recording paper 116.

While the recording paper 116 is being conveyed by the belt conveyance unit 122, a color image is formed on the recording paper 116 by the inks of respectively different colors being ejected from the heads 112K, 112C, 112M and 112Y.

Thus, according to the constitution in which the full line-type heads 112K, 112C, 112M and 112Y with nozzle rows covering the whole of the paper width are provided for the different colors, an image may be formed over the whole face of the recording paper 116 in a single cycle (that is, by a single sub-scan) of the operation of moving the recording paper 116 in the conveyance direction (the sub-scanning direction) relative to the printing unit 112. Therefore, higher speed printing is possible than with a shuttle-type head in which a recording head is reciprocatingly moved in a direction orthogonal to the paper conveyance direction, and productivity may be improved.

In this example, a structure with the standard colors KCMY (four colors) is illustrated. However, combinations of ink colors, numbers of colors and the like are not to be limited by the present exemplary embodiment. In accordance with requirements, paler inks, darker inks and special color inks may be added. For example, a structure is possible in which inkjet heads are added that eject lighter inks such as, for example, light cyan, light magenta and the like. Furthermore, the sequence of arrangement of the heads of the respective colors is not particularly limited.

The print sensor 124 illustrated in FIG. 9 includes an image sensor (a line sensor or an area sensor) for imaging results of impact droplets from the printing unit 112. The print sensor 124 functions as a means for checking ejection characteristics such as clogging of nozzles, impact position errors and the like from an impact droplet image read by this image sensor. A test pattern or practical image printed by the heads 112K, 112C, 112M and 112Y of the respective colors is read by the print sensor 124, and assessments of ejections of the heads are carried out. The ejection assessments are constituted by presence/absence of ejections, measurements of dot sizes, measurements of dot impact positions and so forth. The following is given as a mode of the print sensor 124.

Figure 11:
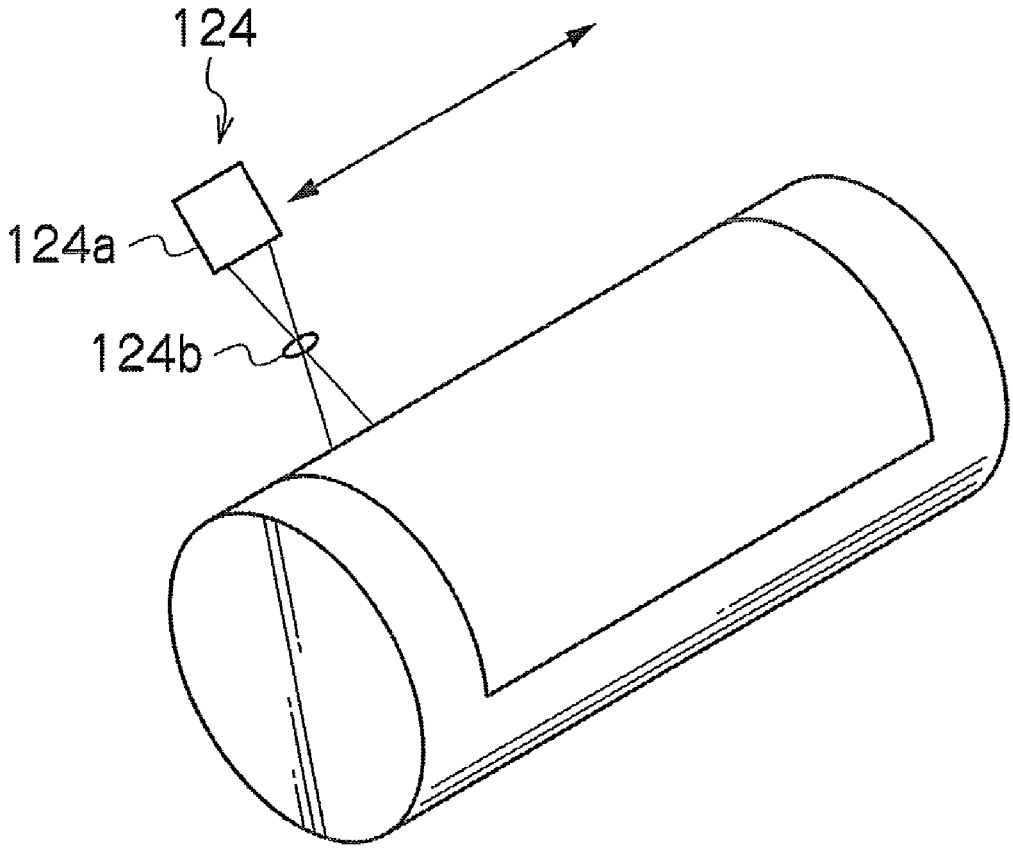
FIG. 11 is a perspective view showing a print sensor.

FIG. 11 is a perspective view showing the print sensor 124. The print sensor 124 is equipped with a line CCD sensor 124*a* and a magnifying optical lens 124*b*. The print sensor 124 reads an image recorded on paper while moving in the width direction of the paper (the direction of the arrow in FIG. 11).

Figure 12:
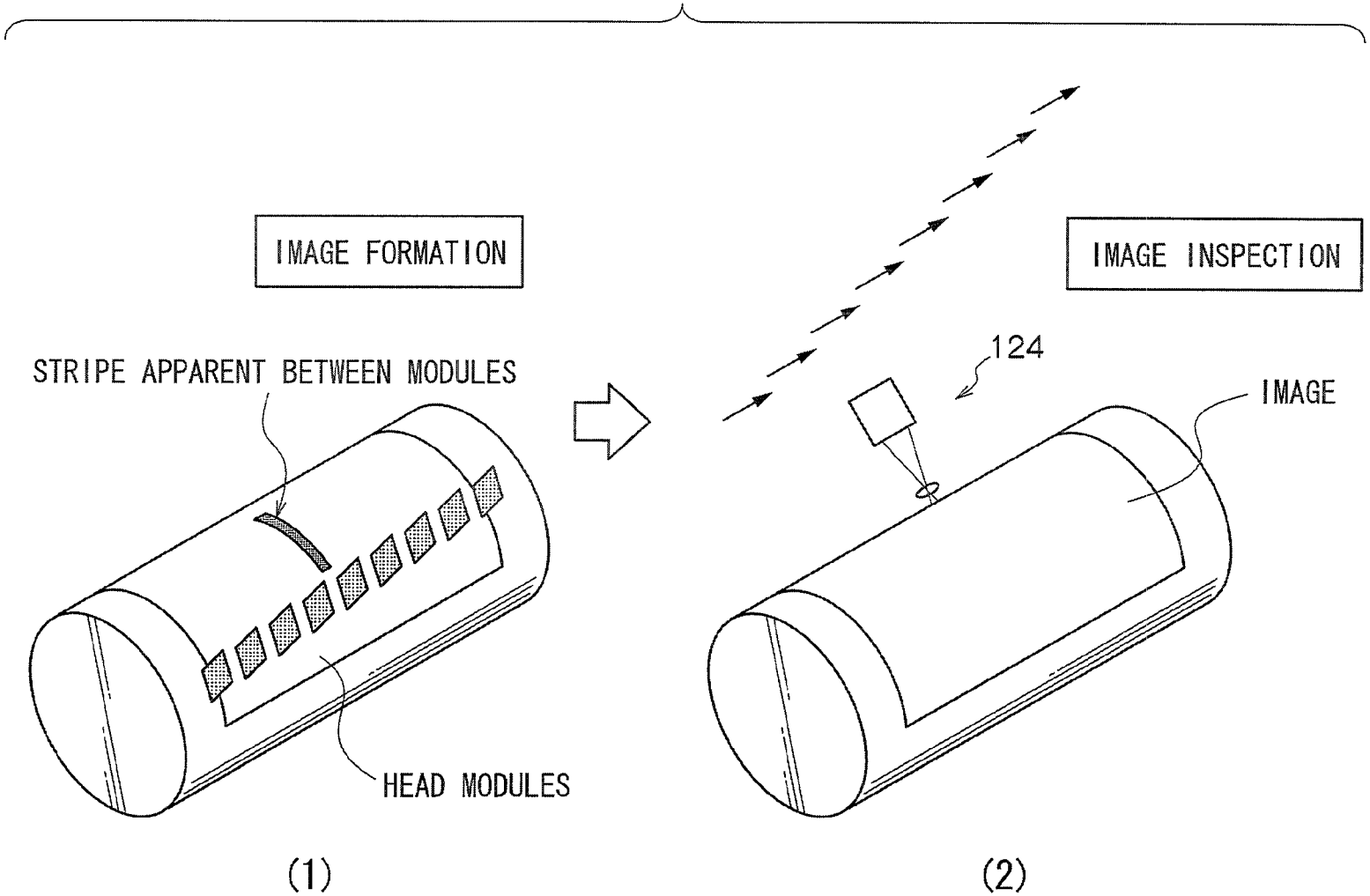
FIG. 12 is a view showing a stripe that is seen between modules, and a view showing a print sensor that inspects for stripes.

FIG. 12 is (1) a view showing a stripe that is seen between modules, and (2) a view showing the print sensor 124 that inspects for stripes. As shown in FIG. 12 (1), the print sensor 124 scans in the paper width direction at predetermined intervals and detects stripes that occur between modules.

Here, the print sensor 124 may scan in the paper width direction with a pitch of, for example, 1 mm, and may sequentially scan in the paper width direction with a specified interval (an equal interval sensing mode). Further, the print sensor 124 may scan with priority being given to regions of joins between the modules that are provided at equal intervals to structure the inkjet head (a priority unit sensing mode). Further yet, if the magnifying optical lens 124*b* is a zoom lens, the print sensor 124 may alter a sensing magnification at designated points in accordance with instructions from a system (a usual mode).

If the line CCD sensor 124*a* has a pixel pitch of 0.002 mm, 21,360 pixels×2×RGB, and a device length of 42.72, then with inspection at 5× magnification, a measurement width on the paper that is inspected is 8.544 mm. Resolution at the paper is 0.0004 mm, and a measurement resolution at the paper of 63,500 dpi is achieved. Thus, an image from a 1200 dpi head may be measured at 63,500 dpi.

Figure 13:
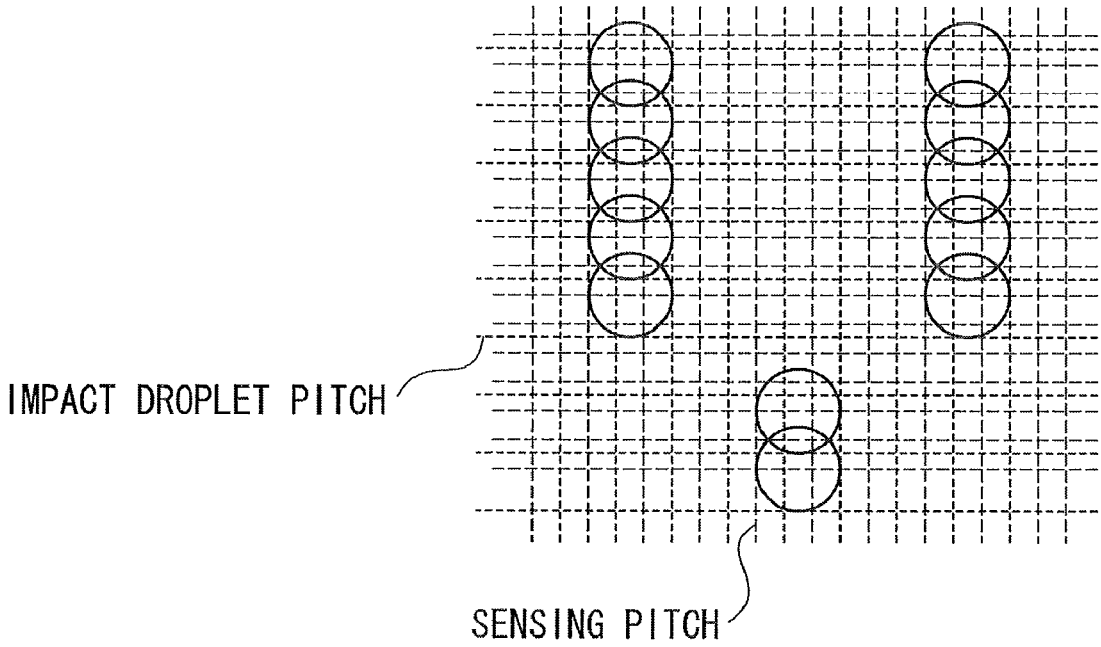
FIG. 13 is a view showing a test pattern.

Because the resolution of measurement is higher, as shown in FIG. 13, a test pattern for when measuring dot spacings and sizes between modules may be set with one to several dots in the paper width direction. It is sufficient that the pattern does not include impact droplet dots of modules or nozzles that neighbor in the paper conveyance direction within a sensing pixel range.

Figure 14:
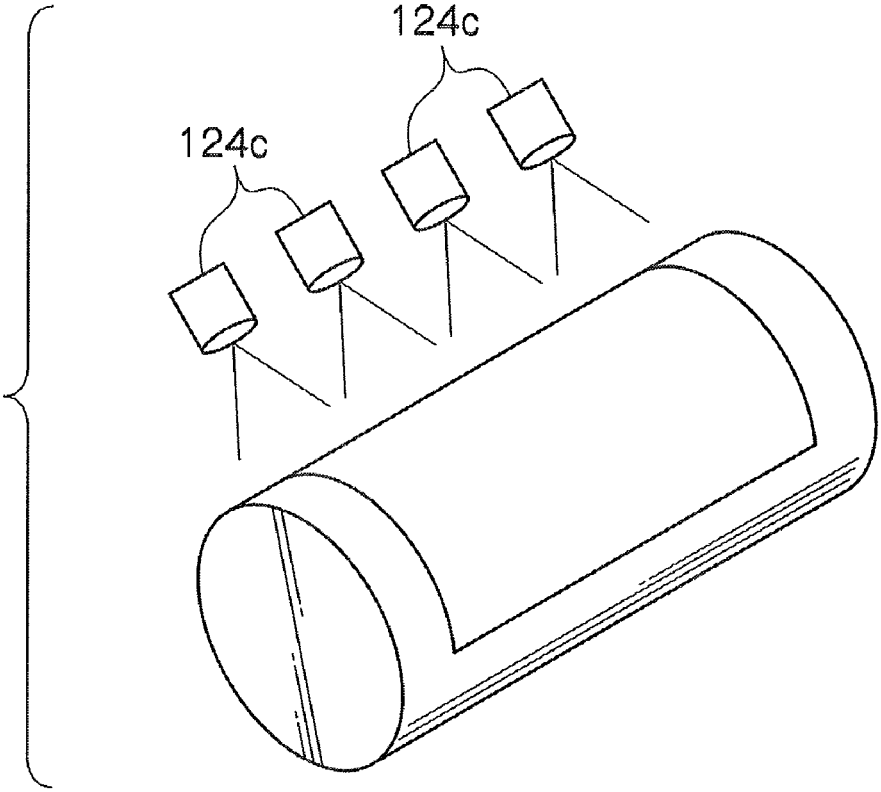
FIG. 14 is a view showing a mode in which plural light sources continuously illuminate the whole width of a paper.

FIG. 14 is a view showing a mode in which plural light sources 124*c* continuously illuminate the whole width of the paper. Thus, regions of scanning by the print sensor 124 may be continuously illuminated.

Figure 15:
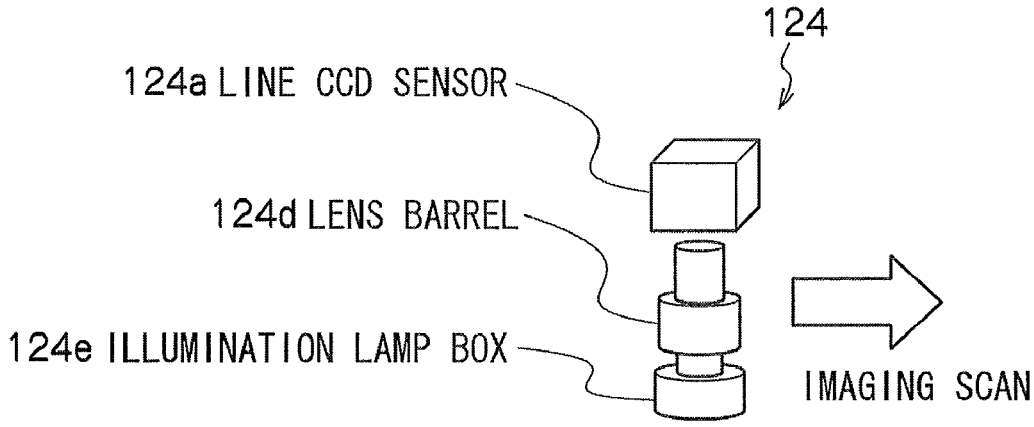
FIG. 15 is a view showing a print sensor equipped with a light source.

FIG. 15 is a view showing the print sensor 124 equipped with a light source. The print sensor 124 is equipped with the line CCD sensor 124*a*, a lens barrel 124*d* and an illumination lamp box 124*e*.

Figure 16:
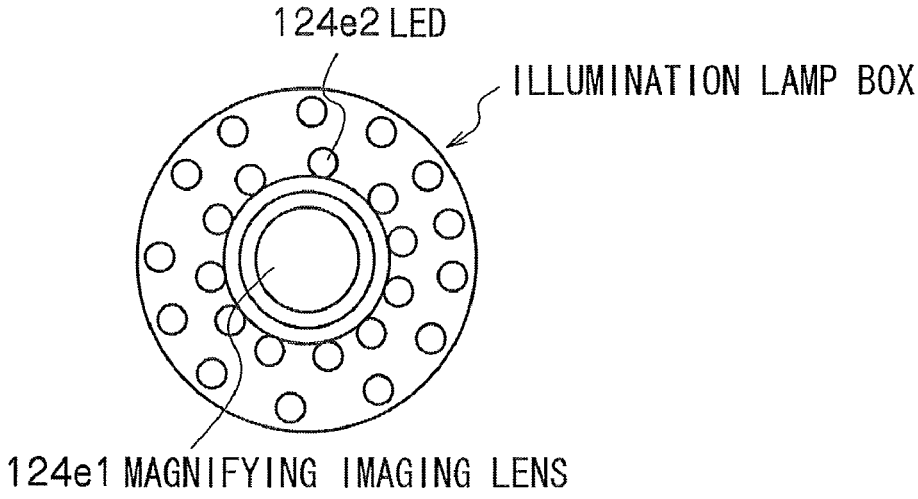
FIG. 16 is a plan view showing a constitution of an illumination lamp box.

FIG. 16 is a plan view showing a structure of the illumination lamp box 124*e*. The illumination lamp box 124*e* is equipped with a magnifying imaging lens 124*e*1, which is disposed at a central portion, and numerous laser light-emitting diodes (LEDs) 124*e*2, which are disposed around the magnifying imaging lens 124*e*1. With such a structure, the print sensor 124 may read an image while illuminating light onto the paper.

Figure 17:
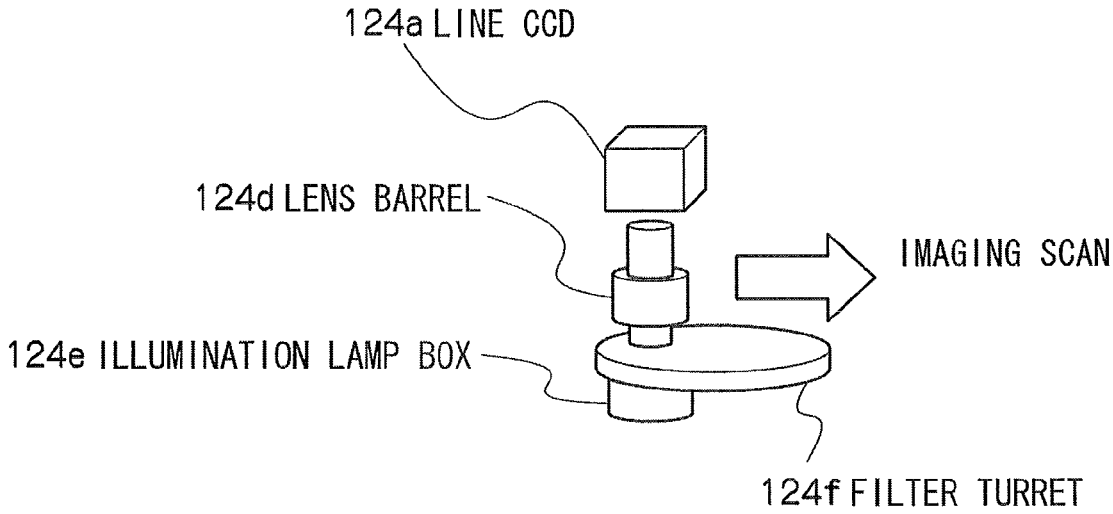
FIG. 17 is a view showing a print sensor capable of altering a wavelength region of illumination light.

FIG. 17 is a view showing the print sensor 124, at which alteration of a wavelength range of illumination light is enabled. The print sensor 124 is equipped with the line CCD sensor 124*a*, the lens barrel 124*d*, a filter turret 124*f* and the illumination lamp box 124*e*.

Figure 18:
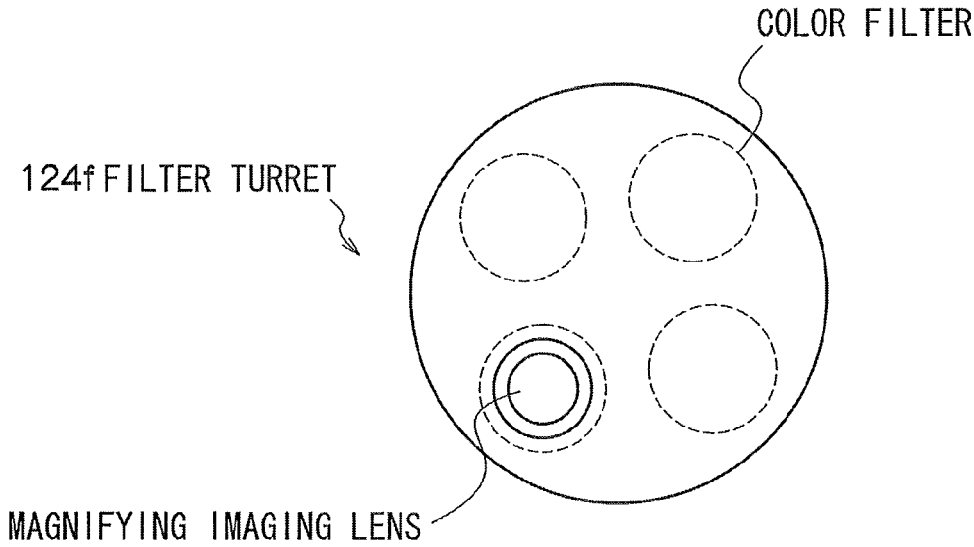
FIG. 18 is a plan view showing a constitution of a filter turret.

FIG. 18 is a plan view showing a structure of the filter turret 124*f*. The filter turret 124*f* is equipped with plural color filters that respectively pass lights of different wavelength ranges. The filter turret 124*f* may set any one of the color filters to the position of the magnifying imaging lens. Thus, the print sensor 124 may read an image while illuminating required light at the paper.

In a case of sensing irregularities in application of a processing agent, for image formation on the paper that includes an infrared absorber, a visible light-cutting filter may be used as a color filter. Thus, the print sensor 124 may read an image while illuminating infrared light at the paper, and sense irregularities of the processing agent.

Figure 19:
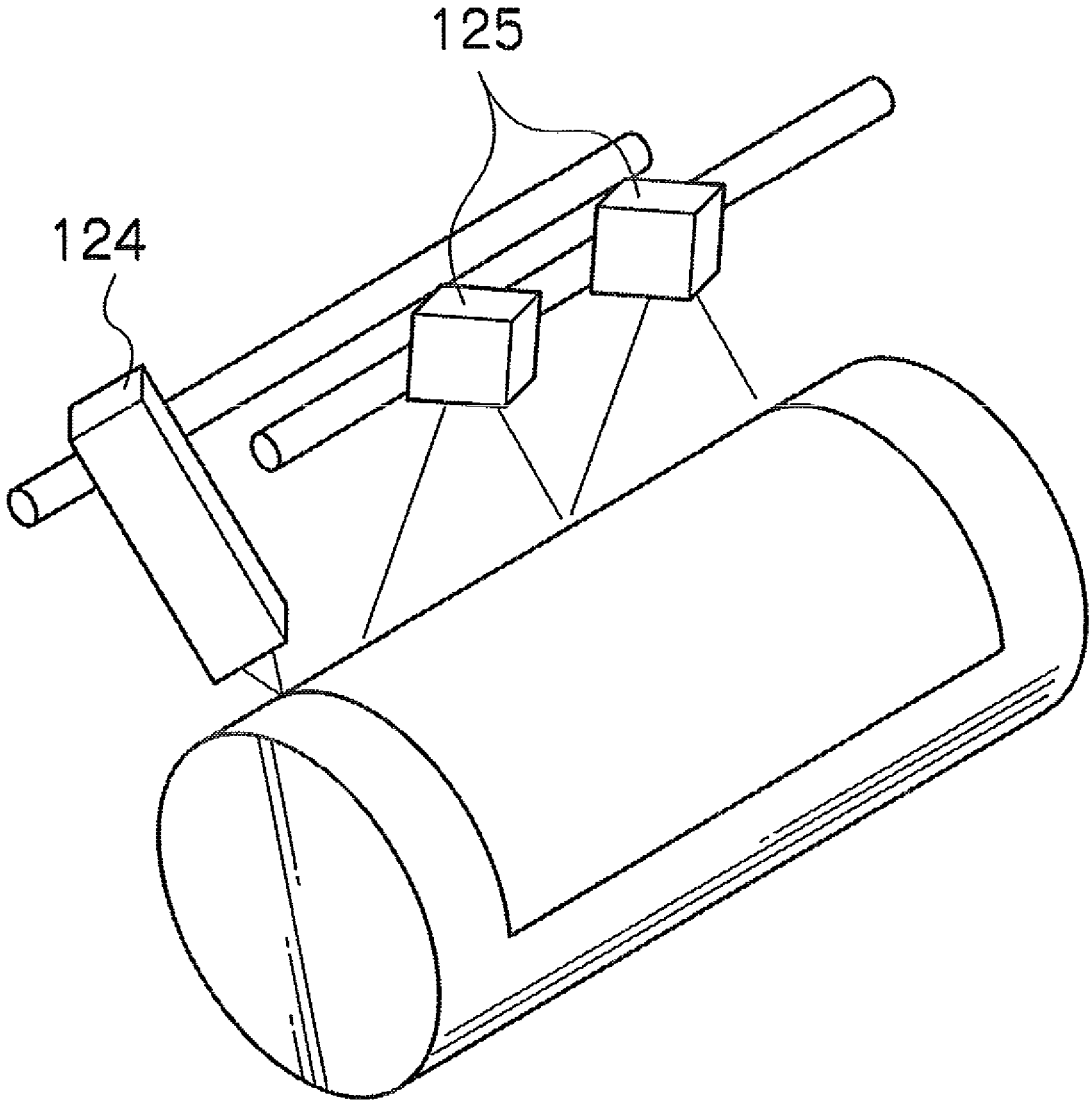
FIG. 19 is a view showing a print sensor that is a paper width direction scanning-type inline sensor, and a print sensor that is a paper image block scanning-type inline sensor.

FIG. 19 is a view showing the print sensor 124, which is a paper width direction scanning-type inline sensor, and a print sensor 125, which is a paper image block scanning-type inline sensor. The print sensors 124 and 125 may be switched as appropriate. The print sensor 124 may be employed when sensing image irregularities between modules and the print sensor 125 employed for image sensing at other times.

A post-drying unit 142 is provided subsequent to the print sensor 124. The post-drying unit 142 is a means for drying the printed image face and uses, for example, a heating fan. After printing, it is preferable to avoid ink coming into contact with the printed face before drying. Therefore, a system that blows hot air may be utilized.

This avoids any contact, which, in a case of printing on porous paper with dye-based ink or the like, would cause pores in the paper to be closed up by pressure and dye components such as ozone and the like to be broken down. Thus, there is an effect in that endurance of images is improved.

A heat/pressure unit 144 is provided subsequent to the after-drying unit 142. The heat/pressure unit 144 is a means for controlling a degree of glossiness of an image surface. The heat/pressure unit 144 heats the image face with a heating roller 145 that features predetermined surface irregularity shapes and applies heat, transferring the irregularity shapes to the image surface.

The printed matter that has been created thus is ejected through the paper ejection unit 126. Main images that are actually intended to be printed (matter on which desired images are printed) and test prints may be ejected separately. In this inkjet recording device 110, a sorting unit (not illustrated) is provided, which sorts main image printed matter from test print printed matter and switches an ejection path to feed to respective ejection units 126A and 126B. If a main image and a test print are formed side by side at the same time on a large piece of paper, the area of the test print is cut off by a cutter (a second cutter) 148. Although not illustrated in FIG. 9, a sorter is provided at the main image ejection unit 126A for collating and stacking images.

—Structure of Heads—

Next, a structure of the heads will be described. Structures of the heads 112K, 112C, 112M and 112Y for the different colors are the same. Therefore, a head with the reference numeral 150 will be illustrated herebelow to represent the heads 112K, 112C, 112M and 112Y.

Figure 20A:
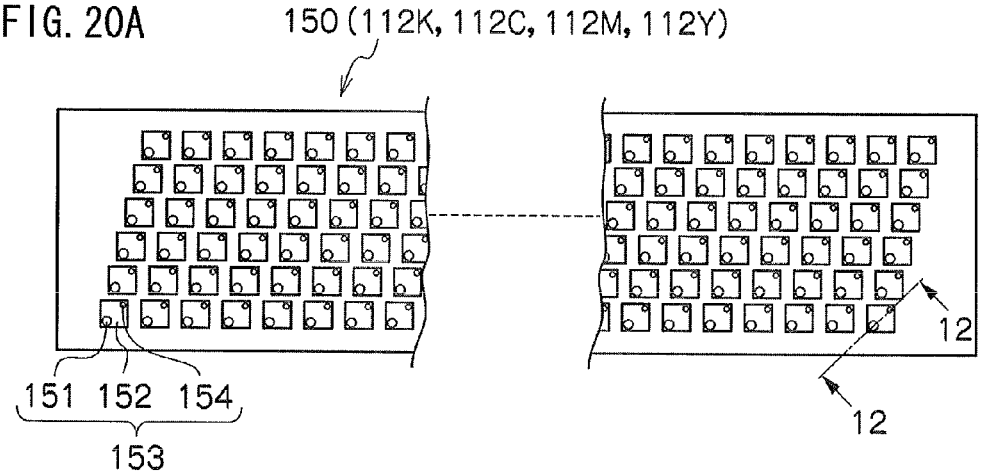
FIG. 20A, FIG. 20B and FIG. 20C are views showing structural examples of head modules.
Figure 20B:
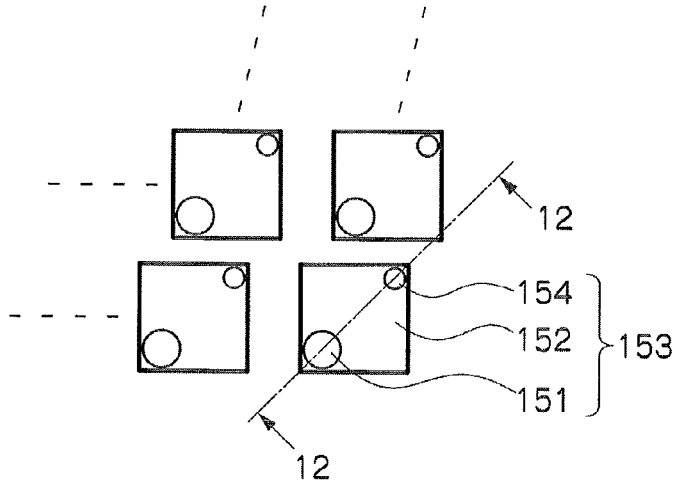
Figure 20C:
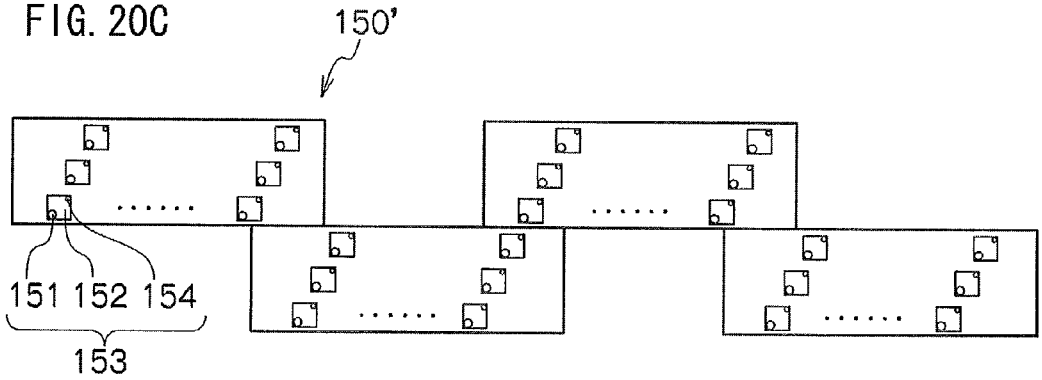
Figure 21:
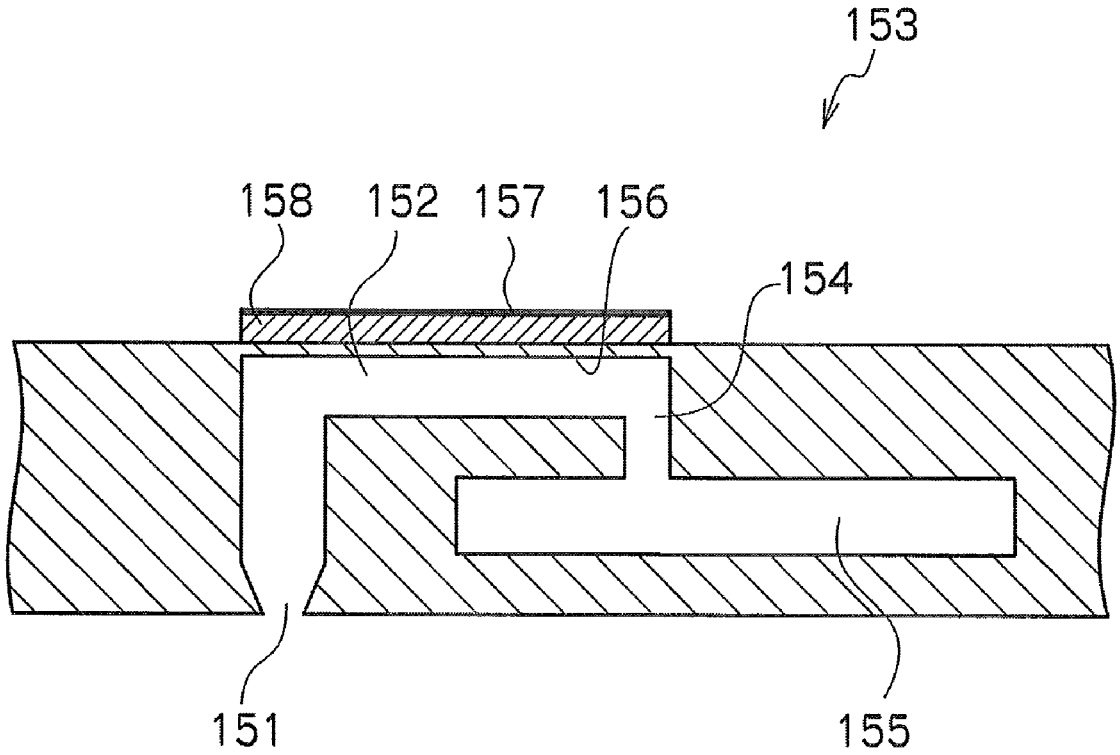
FIG. 21 is a sectional view cut along 12-12 in FIG. 20A.

FIG. 20A is a plan through-view showing a structural example of a first module example 150 constituting a head. FIG. 20B is a magnified view of a portion of FIG. 20A, and FIG. 20C is a plan through-view showing another structural example of the head 150. FIG. 21 is a sectional view (a sectional view cut along 12-12 in FIG. 20A) showing three-dimensional structure of a single droplet ejection element (an ink chamber unit that corresponds with a single nozzle 151).

In order to raise precision of the pitch of dots printed on the recording paper 116, it is necessary to raise the precision of the pitch of nozzles at the head 150. As shown in FIG. 20A and FIG. 20B, the head 150 of the present example has a structure in which the nozzles 151, which are ink ejection apertures, and plural ink chamber units (droplet ejection elements) 153 are (two-dimensionally) arranged in a matrix. The ink chamber units 153 are formed with pressure chambers 152 corresponding with the nozzles 151 and suchlike. Accordingly, an increase in precision of an actual spacing of nozzles, when projected so as to be in a line along a head length direction (a direction orthogonal to the paper feeding direction), (i.e., a projected nozzle pitch) is achieved.

Modes constituted with one or more nozzle rows extending over a length corresponding to the whole width of the recording paper 116 in the direction substantially orthogonal to the feeding direction of the recording paper 116 are not to be limited by the present example. For example, instead of the structure of FIG. 20A, as shown in FIG. 20C, a line head that includes nozzle rows with lengths corresponding to the whole width of the recording paper 116 may be constituted by short-strip head modules 150', in which plural nozzles are two-dimensionally arranged, being arranged in a staggered pattern and joined together.

A plan view shape of the pressure chamber 152 that is provided in correspondence with each nozzle 151 is a substantially square shape (see FIG. 20A and FIG. 20B). An outflow aperture to the nozzle 151 is provided at one of two corner portions on a diagonal of the pressure chamber 152, and an inflow aperture (supply aperture) 154 for supplied ink is provided at the other corner portion. The shape of the pressure chamber 152 is not to be limited by the present example; the plan view shape may be various shapes, such as quadrilateral shapes (rhomboids, rectangles and the like), pentagons, hexagons, other polygons, circles, ellipses, and so forth.

As shown in FIG. 21, the pressure chambers 152 are in fluid communication with a common channel 155 via the supply apertures 154. The common channel 155 is in fluid communication with an ink tank (not shown) which is an ink supply source. Ink supplied from the ink tank is distributed and supplied to the pressure chamber 152 via the common channel 155.

A pressure plate 156 (a diaphragm which is employed in combination with a common electrode) structures a portion of a face of the pressure chamber 152 (the top face in FIG. 21). An actuator 158 equipped with an individual electrode 157 is joined to the pressure plate 156. When a driving voltage is applied between the individual electrode 157 and the common electrode, the actuator 158 deforms and alters the volume of the pressure chamber 152. Accordingly, ink is ejected from the nozzle 151 by a change in pressure. Here, a piezoelectric body of lead titanate silicate, barium titanate or the like is employed. When the displacement of the actuator 158 returns to the original position after ink ejection, new ink is recharged from the common channel 155 into the pressure chamber 152, through the supply aperture 154.

Figure 22:
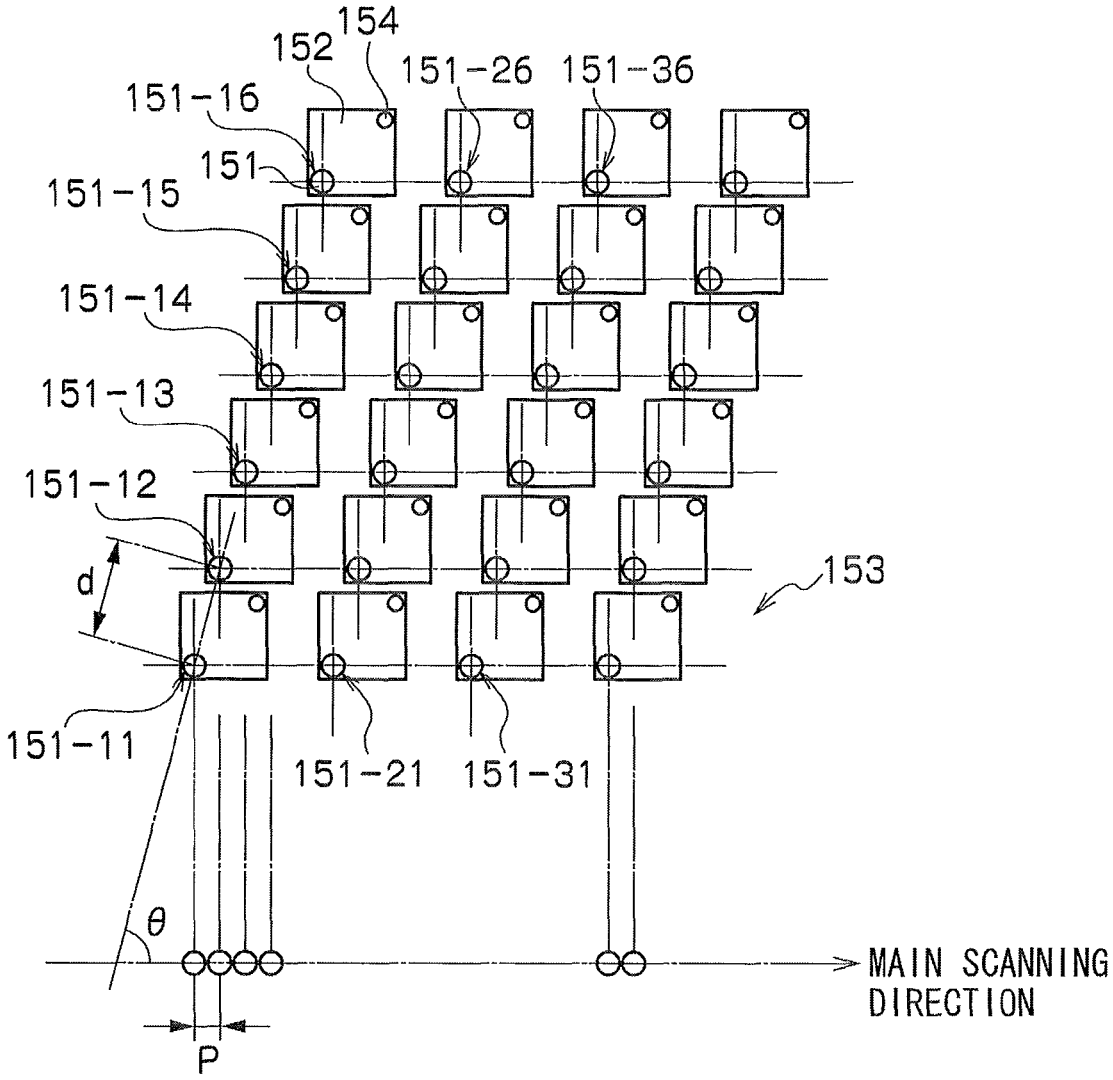
FIG. 22 is a magnified view showing a nozzle arrangement of the head illustrated in FIG. 20A.

As shown in FIG. 22, a large number of the ink chamber units 153 with the structure described above are arranged in a grid with a constant arrangement pattern along a column direction, which is along the main scanning direction, and a row direction, which is not orthogonal to the main scanning direction but inclined at a constant angle θ. In this form, the high-precision nozzle head of the present example is realized.

That is, the plural ink chamber units 153 are arrayed with a constant pitch d along the direction that is at angle θ with respect to the main scanning direction. Therefore, a pitch P of the nozzles projected so as to be in a line in the main scanning direction is $d \times \cos\theta$. With respect to the main scanning direction, the nozzles 151 may be treated as being equivalent to nozzles arranged in a straight line with a constant pitch P. With this structure, a high-precision nozzle constitution in which a nozzle row projected so as to be in a line in the main scanning direction reaches 2400 nozzles for 1 inch (2400 nozzles/inch) may be realized.

With a full line head featuring nozzle rows with a length corresponding to the whole of the printable width, when the nozzles are driven, the following is carried out: (1) simultaneous driving of all nozzles; (2) sequential driving of the nozzles from one end to the other end; (3) division of the nozzles into blocks and sequential driving of each block from one end to the other end; or the like. Driving of the nozzles so as to print a single line (a line of dots of one row or a line formed of dots of plural rows) in the width direction of the paper (the direction orthogonal to the conveyance direction of the paper) is defined as main scanning.

Specifically, in a case in which the nozzles 151 arranged in a matrix as shown in FIG. 22 are driven, main scanning as in the above-mentioned (3) is preferable. That is, nozzles 151-11, 151-12, 151-13, 151-14, 151-15 and 151-16 form a single block (and otherwise nozzles 151-21, . . . , 151-26 form a single block, nozzles 151-31, . . . , 151-36 form a single block, etc.), the nozzles 151-11, 151-12, . . . , 151-16 are sequentially driven in accordance with the conveyance speed of the recording paper 116, and thus a single line is printed in the width direction of the recording paper 116.

Repeatedly performing printing of single lines formed by the above-described main scanning (lines of dots of single rows or lines formed of dots of plural rows), by relatively moving the above-described full line head and the paper, is defined as sub-scanning.

Hence, a direction representing the individual lines recorded by the above-described main scanning (or a strip region length direction) is referred to as the main scanning direction, and the direction in which the above-described sub-scanning is performed is referred to as the sub-scanning direction. That is, in the present exemplary embodiment, the direction of conveyance of the recording paper 116 is the sub-scanning direction and a directional orthogonal thereto is referred to as the main scanning direction.

A structural arrangement of nozzles relating to an embodiment of the present invention is not to be limited to the illustrated example. Moreover, although a system is employed in which ink droplets are caused to fly by deformation of the actuator 158, which is represented as a piezo element (a piezoelectric element), a system for ejecting ink relating to an embodiment of the present invention is not particularly limited thereto. Various systems may be employed instead of the piezo-jet system, such as a thermal jet system in which ink is heated by a heating body such as a heater or the like, air bubbles are formed and ink droplets are caused to fly by pressure therefrom, or the like.

—Description of Control System—

Figure 23:
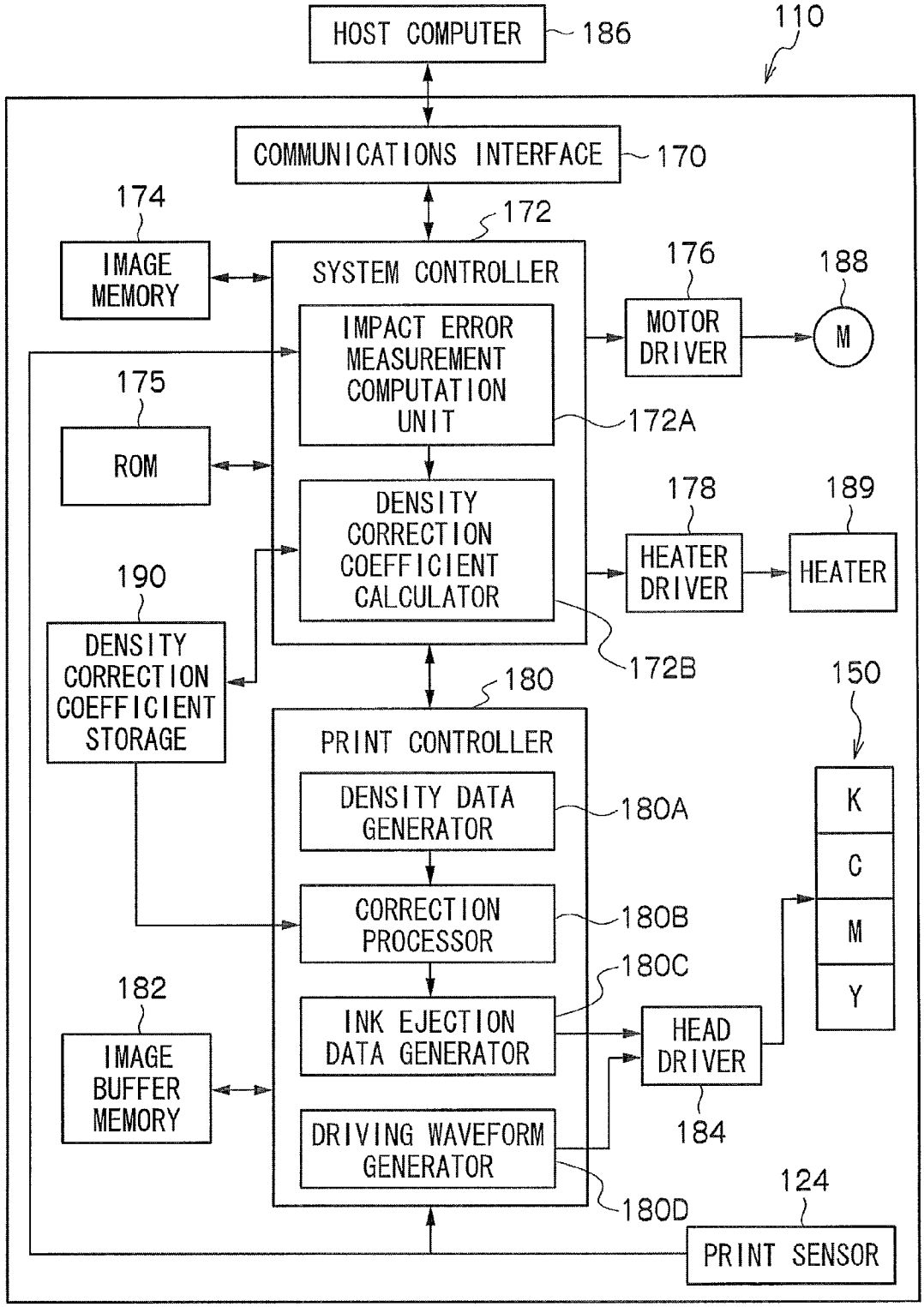
FIG. 23 is a block view of principal elements illustrating a system architecture of the inkjet recording device relating to the present exemplary embodiment.

FIG. 23 is a block view illustrating a system architecture of the inkjet recording device 110. As shown in FIG. 23, the inkjet recording device 110 is equipped with a communications interface 170, a system controller 172, an image memory 174, ROM 175, a motor driver 176, a heater driver 178, a print controller 180, an image buffer memory 182, a head driver 184 and the like.

The communications interface 170 is an interface unit (image input unit) that receives image data arriving from a host computer 186. The communications interface 170 may employ a serial interface, such as USB (Universal Serial Bus), IEEE1394, ETHERNET (registered trademark), a wireless network or the like, or a parallel interface such as CENTRONICS or the like. Because communications at that unit have high speeds, a buffer memory (not shown) may be incorporated.

Image data transmitted from the host computer 186 is read into the inkjet recording device 110 via the communications interface 170, and is temporarily stored in the image memory 174. The image memory 174 is a memorization unit that stores images inputted via the communications interface 170. Writing of data to the image memory 174 is implemented through the system controller 172. The image memory 174 is not limited to memory formed of semiconductor devices; a magnetic medium such as a hard disc or the like may be used.

The system controller 172 is constituted with a central processing unit (CPU) and peripheral circuits thereof and the like, functions as a control device that controls the whole of the inkjet recording device 110 in accordance with a predetermined program, and functions as a computation unit that carries out various computations. That is, the system controller 172 controls the communications interface 170, the image memory 174, the motor driver 176, the heater driver 178 and other units, implements control of communications with the host computer 186 and control of writing to the image memory 174 and the ROM 175, and generates control signals that control a motor 188 of a conveyance system, a heater 189 and the like.

Furthermore, the system controller 172 is structured to include an impact error measurement computation unit 172A and a density correction coefficient calculator 172B. The impact error measurement computation unit 172A performs computation for generating impact position error data from read test pattern data acquired from the print sensor 124. The density correction coefficient calculator 172B calculates the density correction coefficients from the measured impact position information. The processing functions of the impact error measurement computation unit 172A and the density correction coefficient calculator 172B may be realized by ASIC, software or the like, or a suitable combination.

Data of the density correction coefficients that is found by the density correction coefficient calculator 172B is stored in a density correction coefficient storage 190.

Programs that are executed by the CPU of the system controller 172, various kinds of data required for control (including data of the test pattern for impact position error measurements), and the like are stored in the ROM 175. The ROM 175 may be a non-writable memory, and may be a rewritable memory such as an EEPROM. Further, a structure is possible in which, by memory regions of the ROM 175 being utilized, the ROM 175 is also used as the density correction coefficient storage 190.

The image memory 174 is employed as a temporary memory region for image data, and is also employed as a program development region and a calculation work region for the CPU.

The motor driver 176 is a driver (driving circuit) that drives the motor 188 of the conveyance system in accordance with instructions from the system controller 172. The heater driver 178 is a driver that drives the heater 189, of the after-drying unit 142 or the like, in accordance with instructions from the system controller 172.

The print controller 180 functions as a signal processor that carries out processing, such as various processes for generating signals for impact droplet control from the image data in the image memory 174 (multi-value input image data), correction and the like, in accordance with control by the system controller 172, and also functions as a driving control unit that supplies the generated ink ejection data to the head driver 184 and controls ejection driving of the head 150.

That is, the print controller 180 is structured to include a density data generator 180A, a correction processor 180B, an ink ejection data generator 180C and a driving waveform generator 180D. These functional blocks (180A-180D) may be realized by ASIC, software or the like, or a suitable combination.

The density data generator 180A is a signal processor that generates initial density data for each color from the input image data. The density data generator 180A performs the density conversion processing described for step S22 of FIG. 6 (including UCR processing and color conversion or the like) and, as necessary, pixel count conversion processing.

The correction processor 180B of FIG. 23 is a processor that performs density correction calculations using the density correction coefficients that are stored in the density correction coefficient storage 190. The correction processor 180B performs the irregularity correction described for step S32 of FIG. 6.

The ink ejection data generator 180C of FIG. 23 is a signal processor including a halftoning processor that converts from the corrected density data generated by the correction processor 180B to binary (or multi-level) dot data. The ink ejection data generator 180C performs the binarization (or multi-level conversion) described for step S42 of FIG. 6. The ink ejection data generated by the ink ejection data generator 180C is provided to the head driver 184, and controls ink ejection operations of the head 150.

The driving waveform generator 180D is a means for generating driving signal waveforms for driving the actuators 158 corresponding with the nozzles 151 of the head 150 (see FIG. 21). The signals generated by the driving waveform generator 180D (driving waveforms) are supplied to the head driver 184. The signals outputted from the driving waveform generator 180D may be digital waveform data, and may be analog voltage signals.

The image buffer memory 182 is provided at the print controller 180. Data such as image data, parameters and the like may be temporarily stored in the image buffer memory 182 during image data processing by the print controller 180. The image buffer memory 182 in FIG. 23 is shown in a mode of being associated with the print controller 180. However, the image buffer memory 182 may be combined with the image memory 174. A mode is also possible in which the print controller 180 and the system controller 172 are combined and structured by a single processor.

The flow of processing from image input to print output will now be described. Data of an image to be printed is inputted from the outside through the communications interface 170, and is accumulated in the image memory 174. At this stage, for example, RGB multi-level image data is stored in the image memory 174.

At the inkjet recording device 110, an image with apparently continuous gradations to the human eye is formed by finely altering impact droplet densities and dot sizes or the like of fine dots of the inks (colorants). Therefore, it is necessary to convert inputted digital image gradations (image light and shade) to a dot pattern for reproduction that will be as faithful as possible. Accordingly, the original image (RGB) data accumulated in the image memory 174 is provided to the print controller 180 via the system controller 172, and is converted to dot data for each ink color by the density data generator 180A, correction processor 180B and ink ejection data generator 180C of the print controller 180.

That is, the print controller 180 performs processing to convert the inputted RGB image data to dot data of the four colors K, C, M and Y The dot data generated by the print controller 180 in this manner is accumulated in the image buffer memory 182. This dot data for each color is converted to CMYK impact droplet data for ejecting ink from the nozzles of the head 150. Thus, ink ejection data for printing is determined.

The head driver 184 outputs driving signals for driving the actuators 158 corresponding with the nozzles 151 of the head 150 in accordance with print details, on the basis of the ink ejection data and driving waveform signals provided from the print controller 180. The head driver 184 may include a feedback control system for keeping driving conditions of the head consistent.

When the driving signals outputted from the head driver 184 are applied to the head 150 in this manner, ink is ejected from the corresponding nozzles 151. By the ink ejection from the head 150 being controlled synchronously with the conveyance speed of the recording paper 116, an image is formed on the recording paper 116.

As described above, on the basis of ink ejection data and driving signal waveforms generated by required signal processing at the print controller 180, control of ejection amounts and ejection timings of ink droplets from the nozzles is implemented via the head driver 184. Thus, desired impact droplet sizes and impact droplet spacings are realized.

As described for FIG. 9, the print sensor 124 is a block that includes an image sensor. The print sensor 124 reads an image printed on the recording paper 116, performs required signal processing and the like, and detects print conditions (the presence/absence of ejections, sizes and positional irregularities of impact droplets, optical densities, and the like), and provides the detection results to the print controller 180 and the system controller 172.

As necessary, the print controller 180 applies various corrections to the head 150 on the basis of the information provided from the print sensor 124 and, as necessary, performs control to execute preparatory ejection and/or suction, cleaning operations (nozzle recovery operations) such as wiping and the like.

According to the inkjet recording device 110 with the constitution described above, an image may be obtained in which density irregularities due to impact position errors are reduced.

—Modifications—

Embodiments are possible in which the processing functions of the impact error measurement computation unit 172A, density correction coefficient calculator 172B, density data generator 180A and correction processor 180B described for FIG. 23 are wholly or partially incorporated into the host computer 186.

Figure 24:
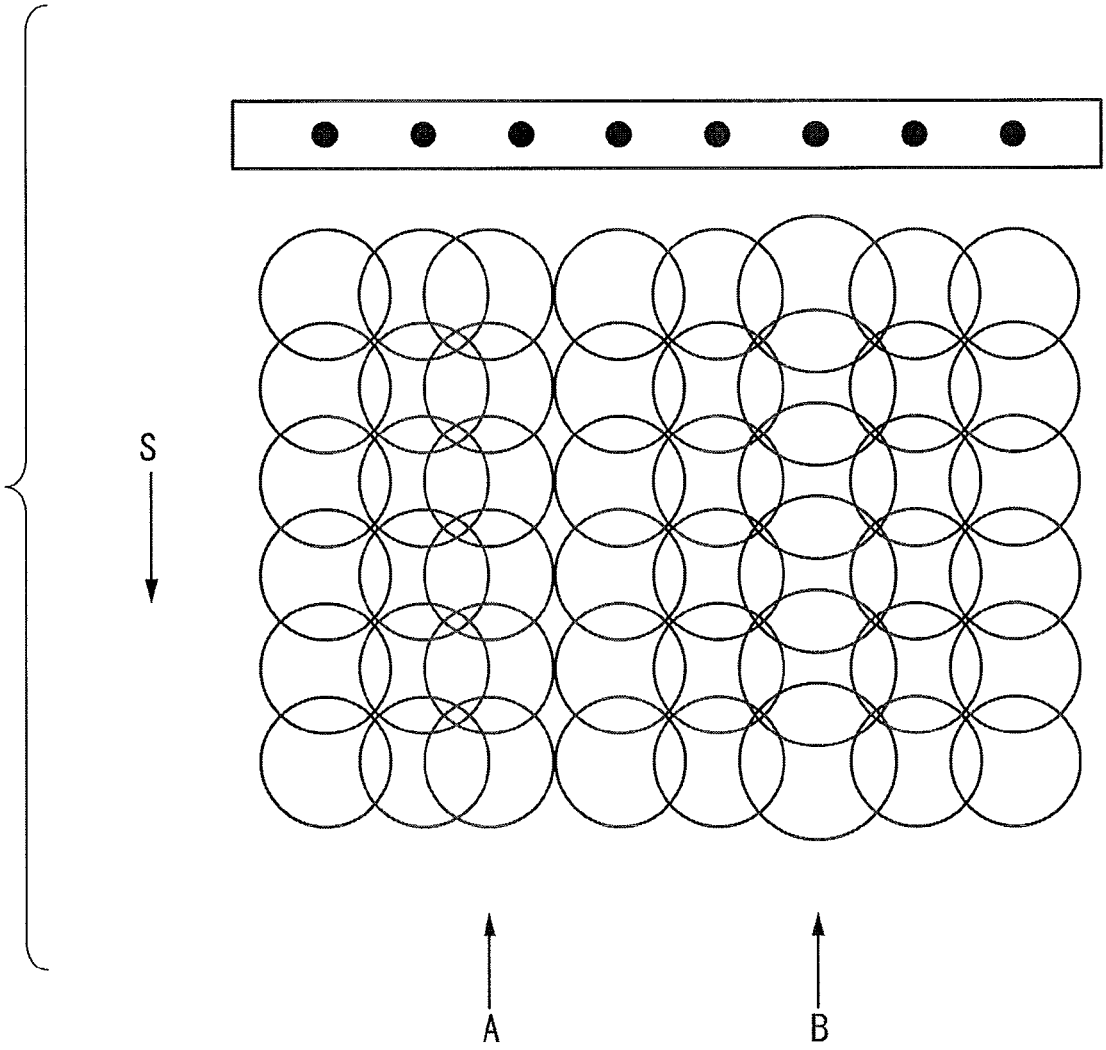
FIG. 24 is a schematic view used for describing a relationship between irregularities in ejection characteristics of nozzles and density irregularities.

A scope of application of the present invention is not limited to correction of density irregularities caused by impact position errors as shown in FIG. 24. Correction effects may also be obtained, by the same techniques as the correction process described above, for density irregularities caused by various factors such as density irregularities due to droplet amount errors, density irregularities due to the presence of non-ejecting nozzles, density irregularities due to periodic print errors, and the like.

Furthermore, application of the present invention is not to be limited to line head-system printers. Useful correction effects may also be obtained for stripe irregularities in serial (shuttle) scanning-system printers.

The present invention is not to be limited by the exemplary embodiment described above; obviously design modifications will be applicable within the scope described in the attached claims.

In the above exemplary embodiment, an inkjet recording device has been described as an example of an image recording device. However, the scope of application of the present invention is not to be limited thus. Besides inkjet systems, the present invention may be applied to image recording devices of various systems, such as thermal transfer recording devices equipped with recording heads in which thermal elements are the recording elements, LED electrophotography printers equipped with recording heads in which LED elements are the recording elements, silver salt photography printers including LED line exposure heads, and the like.

The image forming device described above reads an image recorded at a recording medium while a reading unit moves in a width direction of the recording medium. Therefore, it is possible to inspect for image irregularities between modules that feature plural recording elements that eject ink droplets.

The reading unit may include: a magnification optical system for reading the image recorded at the recording medium at a higher resolution than a resolution of the recording head; and an imaging device at which an imaging surface is structured, at which light from the image recorded at the recording medium is focused via the magnification optical system.

Thus, by using the magnification optical system, the image forming device may inspect for fine image irregularities between modules.

Of the image recorded at the recording medium, the reading unit may move to each of joining portions of the modules of the recording head so as to be capable of reading regions corresponding to the joining portions, and the inspection unit may measure at least one of impact droplet sizes and impact droplet spacings at a face of the image recorded at the recording medium.

Thus, the image forming device may primarily read image irregularities between modules and measure one or both of impact droplet sizes and impact droplet spacings at the image face.

The reading unit may include a light source that illuminates light at the recording medium.

The light source may radiate light of different wavebands.

Thus, the image forming device may inspect for image irregularities while illuminating light at the recording medium.

The light source may illuminate light at the recording medium through any one of plural filters with different transmission wavelength distributions.

Thus, the image forming device may inspect for image irregularities while radiating light of a desired wavelength region at the recording medium.

The light source may illuminate infrared light at the recording medium.

Thus, the image forming device may inspect for application irregularities at a recording medium to which a processing agent that includes an infrared absorber has been applied.

The image forming device may further include a second reading unit that reads a whole width of the image recorded at the recording medium.

Thus, the image forming device may read and inspect the whole width of an image recorded at a recording medium at one time.

The image forming device may further include an image data correction unit that corrects image data provided to the recording head, the recording head recording a predetermined test pattern image at a recording medium, the reading unit reading the test pattern image recorded at the recording medium, and the image data correction unit correcting image data that corresponds to recording elements with ink ejection problems on the basis of the test pattern image read by the reading unit.

Thus, the image forming device may correct image data corresponding to recording elements with ink ejection problems and form a high-quality image.

What is claimed is:

1. An image forming device comprising:

a conveyance unit that moves a recording medium in a conveyance direction;

a recording head comprising a plurality of modules that are joined together such that a total length thereof corresponds to a width of the recording medium, each of the plurality of modules including pluralities of recording elements that eject ink droplets, and the recording head ejecting ink droplets at the recording medium conveyed by the conveyance unit, thereby forming an image;

a reading unit that reads the image recorded at the recording medium by the recording head while the reading unit moves in a width direction of the recording medium, such that in a first mode, the reading unit reads the image with priority given to the regions of the image corresponding to joining portions at which adjacent modules of the plurality of modules are joined together; and an inspection unit that inspects the quality of the image recorded at the recording medium on the basis of the image read by the reading unit.

2. The image forming device according to claim 1, wherein the reading unit comprises:

a magnification optical system that reads the image recorded at the recording medium at a higher resolution than a resolution of the recording head; and imaging elements that form an imaging surface at which light from the image recorded at the recording medium is focused via the magnification optical system.

3. The image forming device according to claim 2, wherein in a third mode, the reading unit, via the magnification optical system, alters a sensing magnification at a designated location of the recording medium in accordance with instructions from a user.

4. The image forming device according to claim 1, wherein the reading unit moves to each joining portion of the modules at which adjacent modules of the recording head are joined, so as to read regions of the image recorded at the recording medium corresponding to the joining portions of the modules, and the inspection unit measures at least one of impact droplet sizes and impact droplet spacings in the image recorded at the recording medium.

5. The image forming device according to claim 1, wherein the reading unit comprises a light source that radiates light at the recording medium.

6. The image forming device according to claim 5, wherein the light source radiates light of different wavelength regions.

7. The image forming device according to claim 5, further comprising a plurality of filters with different transmission wavelength distributions, and wherein the light source radiates light at the recording medium through any one of the plurality of filters.

8. The image forming device according to claim 5, wherein the light source radiates infrared light at the recording medium.

9. The image forming device according to claim 1, further comprising a second reading unit configured to simultaneously read a whole width of the image recorded at the recording medium, and wherein the inspection unit inspects the quality of the image recorded at the recording medium on the basis of the respective portions of images read by the reading unit and the second reading unit.

10. The image forming device according to claim 9, wherein the reading unit is configured to read the regions of the image corresponding to joining portions at which adjacent modules of the plurality of modules are joined together, and the second reading unit is configured to read other regions of the image.

11. The image forming device according to claim 1, further comprising an image data correction unit that corrects image data provided to the recording head, and wherein the recording head records a predetermined test pattern image at the recording medium, the reading unit reads the test pattern image recorded at the recording medium, and the image data correction unit corrects image data that corresponds to recording elements with defective ejection of ink on the basis of the test pattern image read by the reading unit.

12. The image forming device according to claim 1, wherein in a second mode, the reading unit sequentially reads the image at a specific interval along the width direction of the recording medium.

* * * * *